US006880705B2

(12) United States Patent
Ötting et al.

(10) Patent No.: US 6,880,705 B2
(45) Date of Patent: Apr. 19, 2005

(54) STACKABLE CONTAINER

(75) Inventors: Willi Ötting, Warmsen (DE); Jörg Stockmann, Tangstedt (DE); Vedat Pehlivan, Uchte (DE); Axel Lange, Schenefeld (DE)

(73) Assignee: Otting Kunststoffentwicklungs GmbH & Co. KG, Warmsen (DE)

( * ) Notice: Subject to any disclaimer, the term of this patent is extended or adjusted under 35 U.S.C. 154(b) by 189 days.

(21) Appl. No.: 10/381,797

(22) PCT Filed: May 28, 2001

(86) PCT No.: PCT/EP01/06084

§ 371 (c)(1),
(2), (4) Date: Mar. 28, 2003

(87) PCT Pub. No.: WO01/89944

PCT Pub. Date: Nov. 29, 2001

(65) Prior Publication Data

US 2004/0099563 A1 May 27, 2004

(30) Foreign Application Priority Data

May 26, 2000 (DE) ..... 100 26 149

(51) Int. Cl.[7] ..... B65D 21/00
(52) U.S. Cl. ..... 206/505; 211/126.7
(58) Field of Search ..... 206/503, 505, 206/507, 509, 511, 512, 515, 518, 519; 220/23.6, DIG. 14, DIG. 15; 211/126.2, 126.7

(56) References Cited

U.S. PATENT DOCUMENTS

| | | | | |
|---|---|---|---|---|
| 4,320,837 A | * | 3/1982 | Carroll et al. | 206/505 |
| 4,383,611 A | * | 5/1983 | Kreeger | 206/505 |
| 4,519,503 A | * | 5/1985 | Wilson | 206/505 |
| 4,520,928 A | * | 6/1985 | Wilson | 206/505 |
| 4,570,798 A | * | 2/1986 | Wilson | 206/505 |
| 6,394,274 B1 | * | 5/2002 | Cheeseman | 206/511 |

FOREIGN PATENT DOCUMENTS

| | | |
|---|---|---|
| CH | 496 582 | 11/1970 |
| DE | 66 07 304 | 2/1961 |
| DE | 70 18 841 | 8/1970 |
| DE | 33 01 159 A1 | 7/1983 |
| DE | 87 07 228 | 8/1987 |
| DE | 44 32 030 C2 | 2/1995 |
| DE | 44 02 219 A1 | 7/1995 |
| DE | 44 07 973 A1 | 9/1995 |
| DE | 195 16 025 A1 | 10/1996 |
| EP | 0 250 674 A2 | 6/1988 |
| EP | 0 370 771 B1 | 5/1990 |
| EP | 0 553 932 A1 | 8/1993 |
| GB | 2 148 851 A | 11/1970 |
| GB | 2 291 406 A | 1/1996 |

* cited by examiner

*Primary Examiner*—Jes F. Pascua
*Assistant Examiner*—Harry Grosso
(74) *Attorney, Agent, or Firm*—Nixon & Vanderhye P.C.

(57) ABSTRACT

The invention relates to a stackable transport container (30) which has been designed, when in a full condition filled with products, to be stacked with other transport containers on top of each other, or, when in an empty condition, to be placed together with other transport containers inside one another. The transport container has a bottom (2), a front wall (3), a rear wall (4), a left side wall (5) and a right side wall (6) to form a receptacle open towards the top. In the left side wall (5) and in the right side wall (6) respectively, grooves (7, 8) are formed, which respectively have upper groove openings (21, 22) and lower groove stops (10, 11). On the outside of the left side wall (5) and on the outside surface of the right side wall (6) respectively several guide pegs (13) are formed. In a horizontal direction the distances between the guide pegs (13) are different from the distances between the upper openings (21, 22) of the grooves, thus preventing an upper transport container being inadvertently placed inside a lower transport container.

16 Claims, 18 Drawing Sheets

Figure 1:
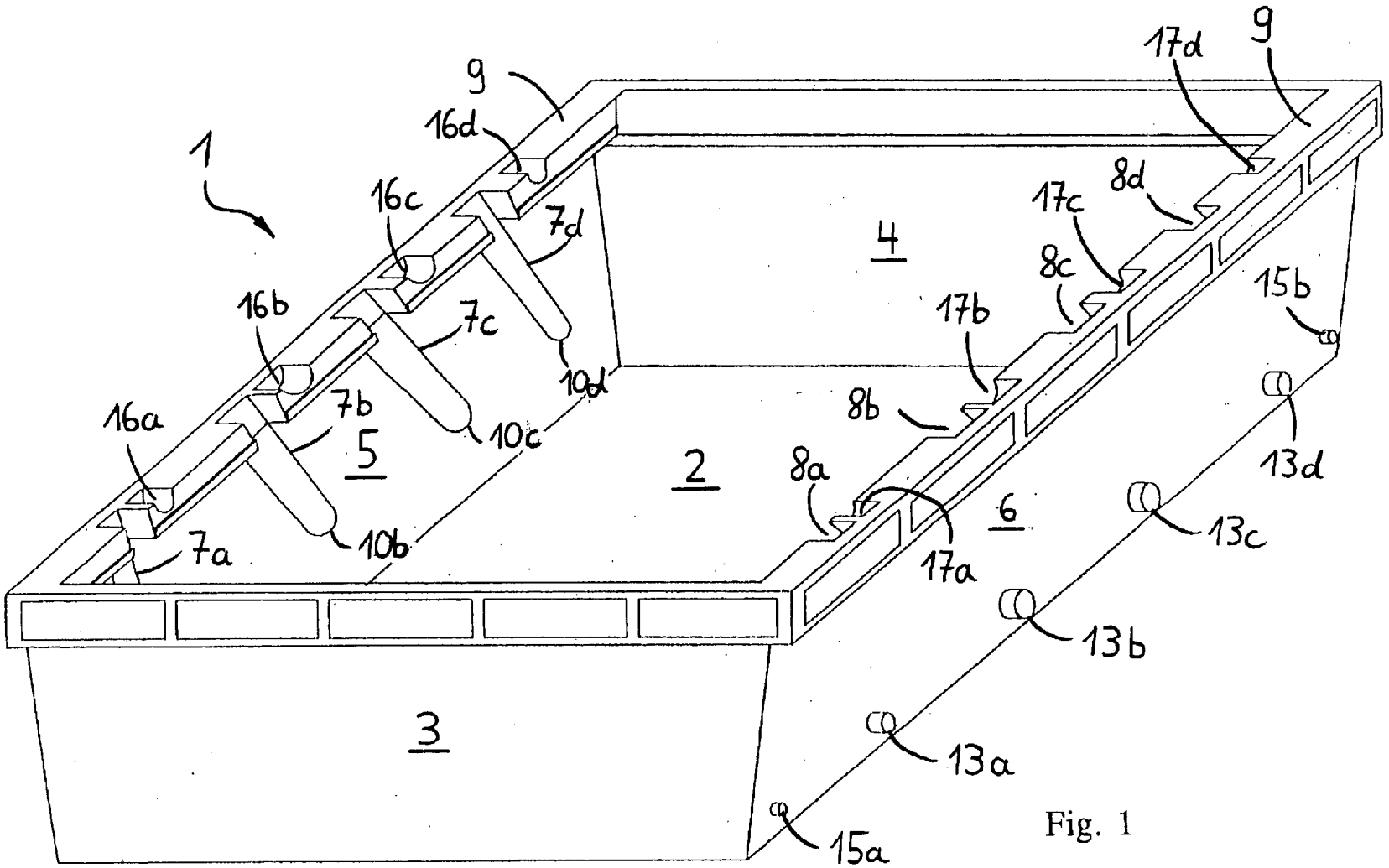

Fig. 15a
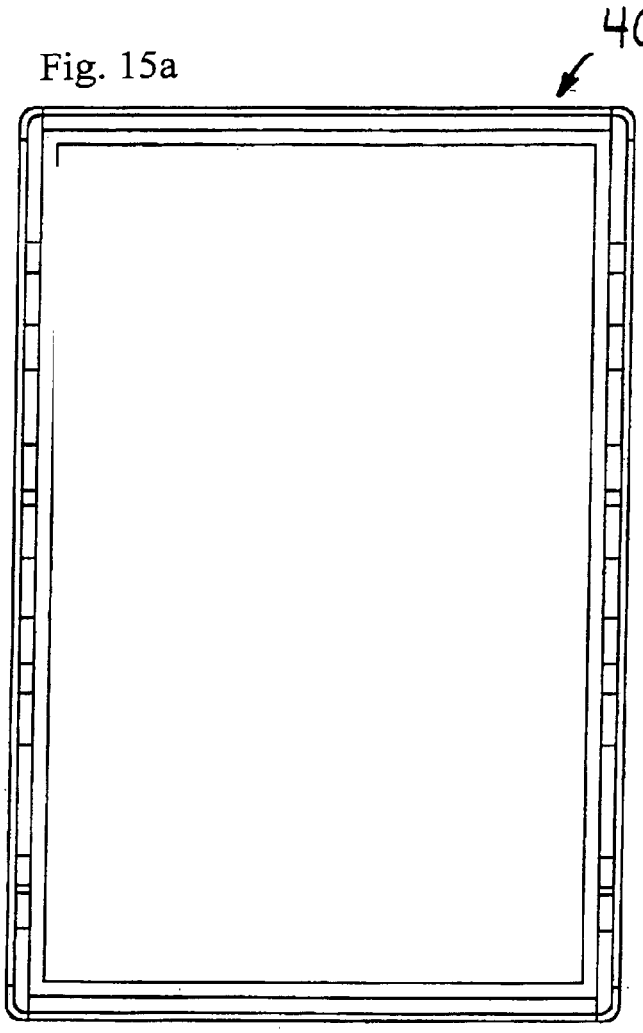
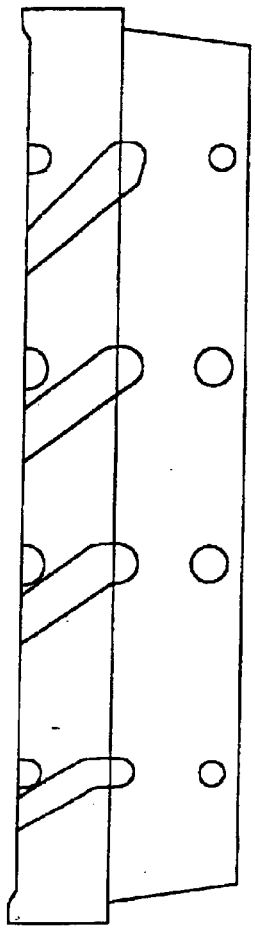
Fig. 15c
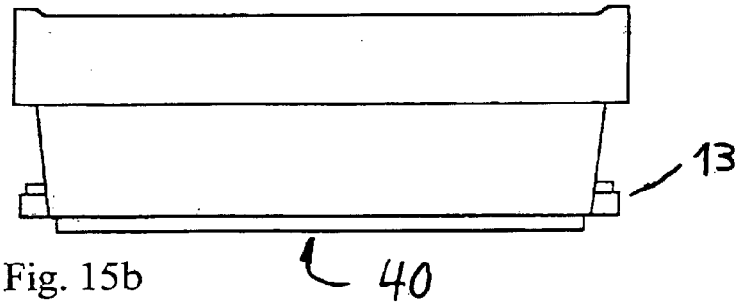
Fig. 15b
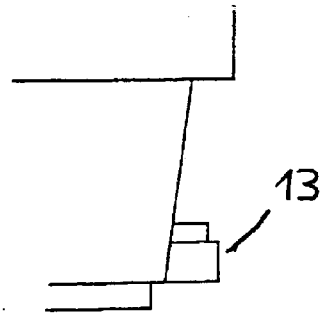
Fig. 15d

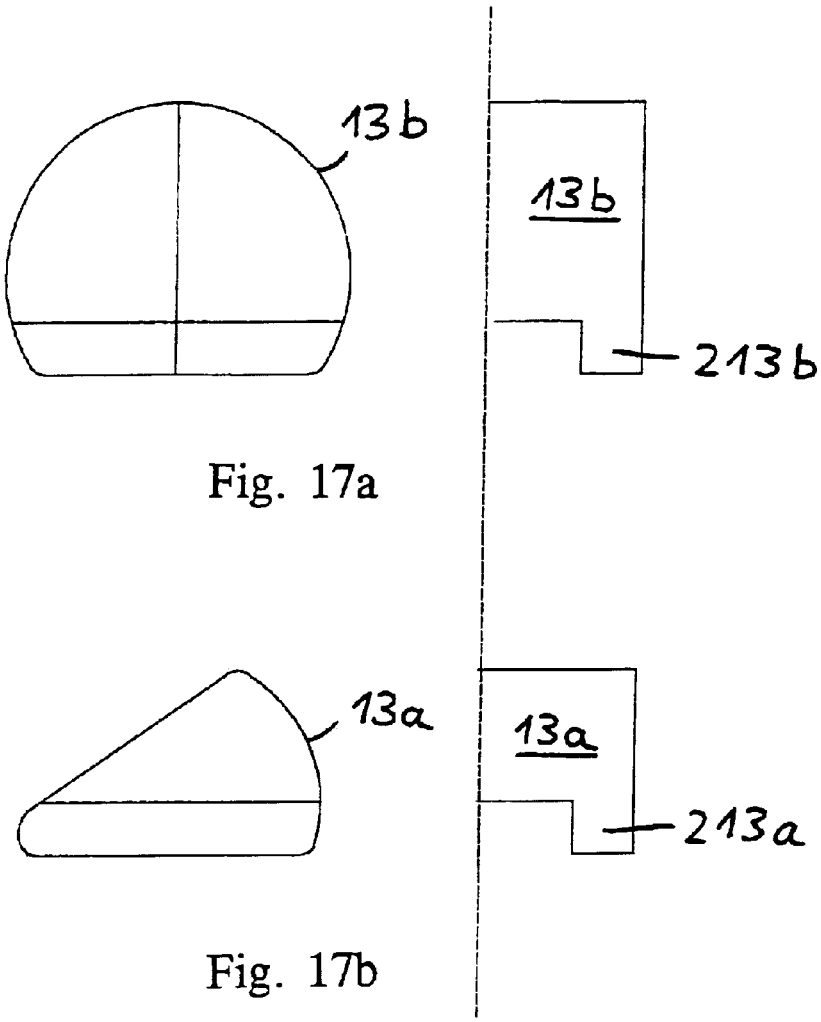
Fig. 17a
Fig. 17b
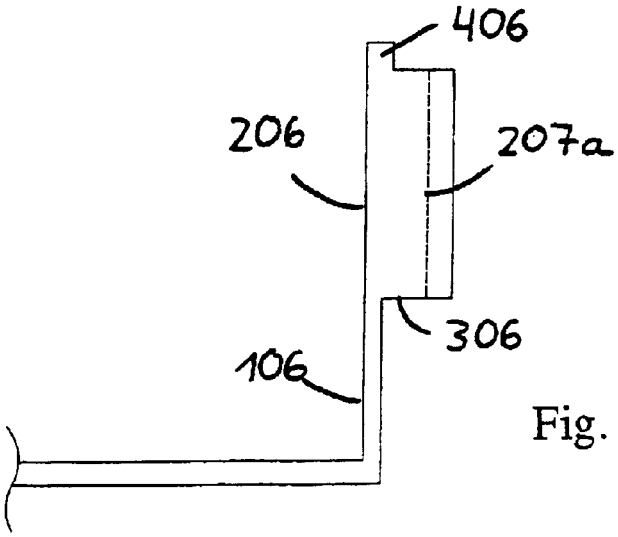
Fig. 18

STACKABLE CONTAINER

This application is the U.S. national phase of international application PCT/EP01/06084 filed 28 May 2001 which designated the U.S.

The present invention relates in general to a stackable transport container according to the preamble to Claim 1. In particular, the present invention relates to a stackable transport container which has been designed, when filled with products in a full condition, to be stacked with other transport containers on top of each other, or, when in an empty condition to be placed together with other transport containers inside one another.

Transport containers have already been known for a long time, for the transport of bread and similar foods from a large bakery to the individual shops, which are therefore also known as bread baskets.

These transport containers have a bottom and a front wall, a rear wall and two opposite side walls, which extend upwards from the bottom at a right angle, to form a receptacle open towards the top. The upper edges of the side walls are formed with a kind of rail that is shaped so that it can engage with projections that are formed at the periphery of the underside of the container bottom of a transport container placed on top of it, if two of these transport containers are stacked on top of one another. In this way, two transport containers stacked on top of one another cannot be displaced relative to one another, as the projections on the underside of the container bottom of the upper transport container engage with the rail on the upper edge of the side walls of the lower transport container. These transport containers are generally used for the delivery of products. The filled containers being stacked on top of each other to form stacks, and then transported for example from a large bakery to the individual shops. The empty transport containers are then later transported back to the large bakery.

The disadvantage of these known transport containers is that, in their empty condition they cannot be placed one inside another to save space, which means that the transport volume of the filled transport containers (filled volume) is the same as the transport volume of the empty transport containers (empty volume).

To overcome this disadvantage, transport containers have been developed that can be both stacked on top of one another and placed inside one another. Transport containers of this type when in a full condition filled with products can be stacked on top of one another, generally with the lower surface of the bottom of an upper transport container resting on the upper edge of the side walls of a lower transport container. This creates a relatively large transport volume (filled volume) for each of the transport containers, which approximately corresponds to the product of the bottom surface and the height of the side walls of such a transport container. Should these transport containers be transported in an empty condition, it is naturally desirable that the transport volume of the empty transport containers (empty volume) should be kept as low as possible. For this reason the side walls of these known transport containers are inclined slightly outwards, in order to enable the empty transport containers to be placed inside one another to save space. In this way a filled volume:empty volume ratio of approximately 2:1 can be achieved.

It is clear that these known transport containers must be constructed so as to be able to be stacked on top of one another and placed inside each other. Various suggestions for this have already been made in the state of the art.

From EP 0 250 674 for example, transport containers are known, that can be stacked on top of one another or placed inside each other at several levels. Such a transport container has a bottom, and side walls sloping upwards from the peripheral edges of the bottom, and at right angles to these, end walls sloping upwards from the peripheral edges of the bottom to form a receptacle open towards the top. On the inner surface of the first side wall, there are two first rows, separated by a certain distance from each other, formed by essentially parallel grooves running at an angle to the vertical, and on the inner surface of the second side wall opposite, there are two second rows separated by a certain distance from each other, formed by essentially parallel grooves running at an angle to the vertical, which essentially correspond to the first two rows that are formed on the inner surface of the first side wall. The individual grooves of each of these four rows have increasingly lower closed ends, so that within each of the four rows, grooves of differing lengths are formed. From the outer surface of the first side wall two first elongated ribs extend outwards, and from the outer surface of the second side wall opposite two second elongated ribs extend outwards, the two first ribs and the two second ribs being formed in such a way, and running at the same angle to the vertical as the grooves, so that the ribs of an upper transport container can in each case engage into an associated groove of the first two rows of grooves, or the second two rows of grooves of a second similar-type transport container placed underneath, so that different stacking heights are possible for stacking on top of one other or placing inside each other.

In these transport containers the distances between the grooves are the same as the distances between the corresponding ribs, which is why the ribs of an upper transport container can easily engage with the corresponding grooves of a lower transport container, if both transport containers are in a horizontal alignment.

The disadvantage of these transport containers is that it is relatively difficult to bring the ribs formed on the outside surfaces of the upper transport container into alignment with a specific groove of the respective rows of grooves which are provided on the inside surfaces of the side walls of a transport container placed underneath. This is because, if filled transport containers are to be stacked on top of one another, the ribs on the outside must in each case be brought into alignment with the shortest grooves. However, if the transport containers are to be placed inside one another, the ribs must in each case be brought into alignment with the longest grooves. If this is not done successfully, and the ribs of the upper transport container are inadvertently pushed into the long grooves of a lower transport container filled with product, the upper transport container is pushed into the internal space of the lower transport container filled with product, and crushes the product inside the lower transport container. It can also easily happen that one of the ribs engages with a long groove, whilst another rib engages with a short groove, so that the upper and lower transport containers tilt against each other so that they can no longer be correctly stacked on top of one another or placed inside each other. In addition the ribs on the outside and the grooves on the inside both run at the same angle to the vertical, so that the containers can only be stacked on top of each other or placed inside each other if correctly aligned, as the external ribs and the internal grooves must extend in the same direction, to allow them to engage with each other. Consequently, if a filled transport container is erroneously placed on top of a transport container underneath in the wrong alignment, the external ribs cannot correctly engage with the internal grooves. The upper transport container must therefore be lifted up again, and turned 180° in a horizontal plane, to bring it into the correct alignment relative to the lower transport container, and place it on top correctly. Lifting the transport container and then turning it, especially in the case of filled transport containers, requires considerable efforts. Moreover the handling of these known transport containers is extremely time consuming.

From EP 0 553 932 transport containers are also known that can both be stacked on top of one another and placed inside each other. A transport container of this kind has a bottom, a rear wall, two side walls opposite each other and a movable stacking support that is positioned at the front of the transport container, to support a transport container of the same type that is to be stacked on top of a lower transport container, so that the bottom of the upper transport container is held and supported at its front end by the stacking support of the lower transport container. In the rear wall of the transport container, there are several recesses, separated from each other vertically, and on the outside of the rear wall, at the level of the bottom there are supporting projections pointing outwards, which are constructed and shaped in such a way that the supporting projections of a transport container lying on top can be inserted from inside into either the upper or lower recess of a transport container lying underneath. Depending on whether the supporting recesses are inserted into the upper or lower recess, different stacking heights can be achieved. The stacking support fixed on the front of the transport container is articulated and can be moved so that the bottom of an upper transport container can be held and supported by the stacking support of the lower transport container at different heights.

The disadvantages of this transport container are that the pivotable stacking support is relatively complicated to manipulate and can soon break. In addition, this transport container is difficult to clean, which is a very important aspect particularly for the transport of food. Finally, the manufacturing costs of this kind of transport container are very high. Finally, the transport containers described above have the disadvantage that they are relatively difficult to stack on top of one another, as a relatively complex movement is necessary to bring the transport containers to be stacked into the correct alignment with each other in each case.

Transport containers of the type described above are often stacked up to form stacks that are very high, with such stacks sometimes reaching a height that is greater than the height of the person carrying out the stacking. Further stacking must then be carried out above head level of this person, which is also described as "blind stacking". Such "blind stacking" means that the transport containers have to be stacked without visual supervision. And it frequently happens that different parts of the transport containers to be stacked, by engaging incorrectly, get stuck on each other, so that the person carrying out the stacking has to exert considerable force to bring the transport containers to be stacked on top of one another into the correct position. In the process, it may happen that a stack of transport containers can tip over, or the transport containers can be inadvertently placed inside each other, possibly damaging the product contained in the transport containers.

There are millions of the transport containers mentioned at the beginning, which cannot be placed inside each other and are often also described as "baker's trays" or "bread baskets". A further disadvantage of the transport containers described above, which can be placed inside each other, is that these transport containers are not compatible with the baker's trays already in circulation. This means that known transport containers which can be placed inside each other cannot be stacked on top of the baker's trays, and vice versa.

Therefore, it is the task of the present invention to provide containers which can be stacked at several levels, or placed inside each other, with the help of which the above-mentioned disadvantages of the transport containers according to the state of the art are overcome.

In particular, it is a task of the present invention, to provide a transport container which is designed to enable and guarantee safe stacking, so that transport containers stacked on top of each other cannot inadvertently be placed inside one another.

In addition, a good ratio between filled volume and empty volume of the transport container stacked on top of each other and/or placed inside each other is to be achieved.

In addition, the transport containers should have only slightly sloping side walls and/or end walls, so as to have as large a filled volume as possible, due to a slight comicality.

Moreover, it should be possible for the transport containers to be stacked on top of each other and/or placed inside each other in different alignments, so that it is not necessary to bring the upper container in a specific alignment relative to the lower container to be able for the transport containers to be stacked on top of each other and/or placed inside each other.

The transport containers according to the invention should also be compatible with the baker's trays mentioned at the start so that the transport containers according to the invention can be used together with the known baker's trays.

Finally the transport containers according to the invention should have no moving parts and be easy to clean.

These tasks are solved by a transport container with the features of Claim 1. In the sub-claims advantageous and preferred further developments of the transport container according to the invention are given.

The above transport containers for the transport of bread and similar foods were described to explain the state of the art. However, it is clear that the transport container according to the invention can also be used in other areas and is under no restrictions with regard to its size, use and the material used. Thus, the transport container according to the invention can be used for the transport of bread, vegetables, meat and eggs. Further, the transport container according to the invention can be used for example for the transport of machine parts, or for the transport of building rubble, in the form of a large steel container.

The transport container according to the invention has a bottom, a front wall, a rear wall, a left side wall and a right side wall, which are sloping slightly outwards, to form a receptacle open towards the top.

Alternatively, the left side wall and the right side wall (and, if desired, also the front wall and/or the rear wall) can be formed in a step-like configuration, wherein these walls each having a first substantially vertically extending lower wall portion and a second substantially vertically extending upper wall portion, wherein the lower and upper wall portions being connected by means of a slightly inclined outwardly extending connecting portion. Thus, the lower wall portions define a horizontal substantially rectangular cross section plane which is larger than a horizontal substantially rectangular cross section plane defined by the upper wall portions. Further, the lower wall portions and the upper wall portions are sized so that the lower part of the transport container defined by the lower wall portions can be inserted in the upper part of an underneath transport container defined by the upper wall portions, i.e., the outer dimensions of the lower part substantially correspond to (or being less than) the inner dimensions of the upper part.

Substantially at the level of the connecting portion, a horizontally extending flange is formed at the outer surface of the side walls and, if desired, at the front wall and/of the rear wall. When two containers are placed inside one another, the downward surface of the horizontal flange lies on the upward surface of the upper wall portions of the side walls and, if resent, of the front wall and/of the rear wall. By means of such a construction, the strength of the transport container is increased. Further, the transport containers can be placed inside one another more easy, and canting in this condition is minimized.

The front wall and the rear wall may have a height which is less than that of the two side walls. Additionally, the front wall and the rear wall may have different heights.

In the left side wall and in the right side wall, at least two grooves are formed, which have upper openings at the upper edge of the side walls, and lower closed groove stops. These grooves are open towards the inner space of the container and, therefore, are accessible. Consequently, the grooves extend from the upper edge of the side walls, where the grooves are open and accessible, down to the groove stops, which are preferably located at half way of the side walls and preferably in the lower half of the side walls. These grooves can be formed as channels in the inside surface of the side walls in question, or extend completely through the side walls in the form of slits, making possible lower conicality of the side walls. The grooves can also be formed by means of rib-like extensions at the inner surface of the side walls, or by means of a laterally displaced arrangement of different side wall sections, or by other means known by a person skilled in the art.

In addition, at least two guide pegs are formed on the outside of the left side wall and on the outside of the left side wall, wherein the number of guide pegs on the outsides in each case being equal to the number of grooves formed in the side walls. These guide pegs are located approximately at the height of the bottom of the transport container to ensure a rigid connection to the bottom which is preferred for reasons of increased strength. The guide pegs are formed in such a way that the guide pegs of an upper transport container can be inserted through the groove openings into the grooves of a transport container underneath. The grooves are shaped so that the guide pegs of the upper transport container can slide into the grooves of the lower transport container downwards as far as the groove stops, when two transport containers are placed inside one another. Further, the outermost ends of the guide pegs are provided with downwardly extending protrusions for engaging with an upwardly extending rib or a channel formed at the upper surface of the side walls of a transport container underneath when both transport containers are stacked on top of each other. Thereby, it can be better prevented that two transport containers can be inadvertently placed inside each other. Further, the upper surfaces (support surface) may be provided with suitable ribs for engaging with the downwardly extending protrusions of the guide pegs to ensure increased strength when placed inside one another.

In a first embodiment of the transport container of the present invention, in a horizontal direction the distances between the guide pegs are different from the distances between the upper openings of the grooves. It is thus ensured that with horizontal position and vertical alignment of two transport containers situated on top of each other, i.e., the two transport containers are situated on top of each other in horizontal and parallel relationship, not all the guide pegs of the upper transport container can simultaneously penetrate into all the upper openings of the grooves of the lower transport container, thus preventing the upper transport container being unintentionally placed in the lower transport container. Consequently, the upper transport container can only be placed inside the lower transport container by a type of plunging movement (condition of being one inside the other). To do this, the upper transport container is inclined in relation to the lower transport container and the front, lowest guide peg is inserted into the front groove of the lower transport container and then being moved downwardly. In this way, the following guide peg is brought into alignment with the following groove opening and can be inserted into the appropriate groove. If there are more than two grooves or guide pegs on each side of the transport containers the third guide peg can then also be inserted into the third groove, and so on.

In this way the guide pegs of the upper transport container can only be inserted one after the other into the appropriate grooves of the transport container underneath by means of the plunging movement as explained, until the guide pegs push against the appropriate groove stops of the corresponding grooves. It is clear that in a horizontal direction the distances between the guide pegs are equal to the distances between the groove stops, to make it possible for the upper transport container to be placed inside the lower transport container in a horizontal position (i.e. a horizontal and parallel relationship of two transport containers one above the other).

In a second embodiment of the transport container of the present invention, in a horizontal direction the distances between the guide pegs can be equal to the distances between the upper openings of the grooves. In this second embodiment, at least three guide pegs are formed on the outside of the left side wall and on the outside of the left side wall, wherein the central guide peg (guide pegs) is (are) shorter and preferably thicker than the outermost guide pegs. The horizontal cross sections of the grooves and the upper openings of the grooves, the number of which is equal to the number of the guide pegs, correspond to the shape of the respective guide pegs. This means that the groove openings and the grooves are formed in such a way that the outermost guide pegs can only received in the outermost groove openings and grooves, and the inner (central) guide pegs can only be received in the inner (central) groove openings and grooves. In other words, the outermost groove openings and grooves are deeper and narrower (more slim) for being able to receive the longer and preferably thinner outermost guide pegs, and the central groove openings and grooves are more shallow and wide for being able to receive the shorter and preferably thicker central guide pegs. Of course, the central guide pegs can be longer and/or thinner than the outermost guide pegs, wherein the respective groove openings and grooves have a corresponding shape. It is noted that other groove shapes and guide peg shapes are possible. However, it is important that the different grooves and guide pegs are formed in such a way that the outermost guide pegs can only be inserted in the outermost grooves and, preferably, the central (inner) guide pegs can only be inserted in the central (inner) grooves. Further, it is noted that the shape and arrangement of the grooves and the guide pegs is symmetrically.

By means of the above features it is thus ensured that, when two transport containers according to the second embodiment of the invention are situated on top of each other, the guide pegs of the upper transport container can only penetrate into all the upper groove openings and grooves of the lower transport container when the guide pegs of the upper transport container are in alignment with the corresponding groove openings of the lower transport container. Thus, when an upper transport container is pushed over the lower transport container for being stacked on top of the lower transport container, the front guide peg in pushing direction of the upper transport container can not unintentionally penetrate, because of its longer shape, into in central shallow groove opening. In the same way, a central thick guide peg can not unintentionally penetrate into an outermost narrow groove. Therefore, it is prevented that the guide pegs of the upper transport container can penetrate into the wrong upper groove openings of the lower transport container, thus preventing the upper transport container unintentionally being placed in the lower transport container when the upper transport container being pushed over the lower transport container. Consequently, when an upper transport container according to the second embodiment of the invention is, for the purpose of stacking, pushed over a lower transport container, the front (in pushing direction) longer guide pegs slide over the central shallow groove openings of the lower transport container without penetrating into the central groove openings. When the front (outermost) longer guide pegs of the upper transport container are in alignment with the corresponding front (outermost) deeper groove openings of the lower transport container, then also all other guide pegs of the upper transport container are in alignment with the corresponding groove openings of the lower container, and all guide pegs simultaneously can penetrate into the corresponding grooves such that the upper transport container can be inserted into the lower transport container. It is obvious that the upper transport container can be inserted into the lower transport container without the plunging movement as described above. When the guide pegs of the upper transport container are in alignment with the groove openings of the lower transport container, then the upper transport container can be inserted with a vertical or diagonal movement in a downward direction, whereby the guide pegs of the upper transport container simultaneously slide into the grooves of the lower transport container, which is advantageous for automatic stacking. It is obvious that the described shape and structure of the grooves and guide pegs can also be used in the first embodiment.

In addition, in both embodiments of the transport container of the invention, recesses are preferably made in the upper edges of the right side wall and the left side wall, so that the guide pegs of an upper transport container can engage with the recesses of a transport container underneath (stacked condition), so that the two transport containers thus stacked on top of one another cannot be displaced relative to each other. To enable the guide pegs of the upper transport container to engage with the recesses of the lower transport container, the distances between the recesses must be equal to the distances between the guide pegs. As described above, when the outermost ends of the guide pegs are provided with downwardly extending protrusions for engaging with an upwardly extending rib or a channel formed at the upper surface of the side walls of a transport container underneath when both transport containers are stacked on top of each other, then, preferably the recesses are also provided with such a rip or channel to prevent that the guide pegs inadvertently slide away towards the inner space of the transport container and to prevent the two transport containers can be inadvertently placed inside each other.

In the second embodiment of the transport container of the invention, the cross sections of the recesses correspond to the cross sections of the guide pegs so that, for example, an outermost longer guide peg of the upper transport container can not penetrate into a central shallow recess. As already mentioned above, also in the second embodiment the protrusions at the guide pegs and the rip or channels can be provided.

In the second embodiment, when an upper transport container is pushed over the transport container underneath for being stacked on top of the transport container underneath, the front guide peg in pushing direction of the upper transport container can not unintentionally penetrate, because of its longer shape, into in central shallow groove opening or into a central shallow recess. In the same way, a central thick guide peg can not unintentionally penetrate into an outermost narrow groove or into an outermost narrow recess. Therefore, it is prevented that the guide pegs of the upper transport container can penetrate into the wrong recesses of the lower transport container, thus preventing the guide pegs of the upper transport container can penetrate into the wrong recesses of the lower transport container, therefore, interlocking of the guide pegs of the upper transport container with the wrong recesses of the transport container underneath is prevented when the upper transport container being pushed over the lower transport container. Consequently, when an upper transport container according to the second embodiment of the invention is, for the purpose of stacking pushed over a transport container underneath, the front (in pushing direction) longer guide pegs slide over the central shallow groove openings of the lower transport container without penetrating into the central groove openings. When the front (outermost) longer guide pegs of the upper transport container are in alignment with the corresponding front (outermost) deeper recesses of the lower transport container, then all other guide pegs of the upper transport container are also in alignment with the corresponding recesses of the lower transport container, and all guide pegs can simultaneously penetrate into the corresponding recesses such that the upper transport container can be stacked on top of the lower transport container.

Preferably, in both embodiments the dimensions and designs of the bottom and of the guide pegs are preferably to be selected so that a transport container according to the invention can be stacked on top of a known baker's tray, with the bottom and the guide pegs of an upper transport container according to the invention engaging properly with the rail of a lower baker's tray. The upper edges of the side walls and the front and rear wall of the transport container according to the invention are dimensioned so that they engage with the peripheral edge of the bottom and with the projections on the underside of the bottom of an upper-baker's tray. In this design the transport container according to the invention is compatible with the known baker's tray and a combination of these can be stacked on top of one another; however it is not possible for the transport containers and baker's trays to be placed inside one another. Preferably, at the outer areas of the corners of the upper surface of the rail protrusions or upward ribs are provided, thus preventing an upper baker's tray can slide along the rail of a lower transport container according to the invention. In particular, this is important for transport containers according to the invention which have a front wall and/or rear wall which is lower in height.

In both embodiments of the transport container according to the invention, four grooves, four recesses and four guide pegs are preferably formed on each side wall.

According to the above considerations, the grooves are at an angle to the vertical, so that in general the groove stops are positioned, in vertical direction, with a distance under the recesses. Further, the guide pegs are positioned in vertical alignment with the groove stops and the recesses.

In the first embodiment of the transport container according to the invention, the grooves have a different slope, shape and curve, with the corresponding opposite grooves in the other side wall are identical, respectively. In other words, the grooves in one side wall all have a different shape, with the side walls are identical and axially symmetrical. The precise shape, slope and curve of the grooves from the groove opening in the upper edge (rail) of the side walls to the groove stop depends on the desired nature of the plunge movement, number of and distance between the guide pegs etc.

In the second embodiment of the transport container according to the invention, the grooves are also at an angle to the vertical, however, the grooves have the same shape and orientation. The precise shape, slope and curve of the grooves from the groove opening in the upper edge (rail) of the side walls to the groove stop depends on the number of and distance between the guide pegs and the groove openings. Preferably, the lower groove stops of a groove, the above corresponding recesses and the guide pegs are in vertical alignment to each other.

The essential advantage of the transport container according to the invention consequently consists in the special shape and arrangement of the grooves/slits and the guide pegs ensuring safe stacking of the transport containers filled with product on top of one another, and at the same time prevents the transport containers inadvertently being placed inside one another when being stacked on top of one another.

The shape and arrangement of the grooves and guide pegs according to the invention also makes it possible for the transport containers to be stacked on top of one another and/or placed inside one another in different alignments.

A further advantage of the transport container according to the invention consists in the fact that a good ratio of filled volume:empty volume is achieved. This means that the volume of transport containers stacked on top of one another compared with the volume of transport containers placed inside one another is relatively large. This good filled:empty ratio preferably amounts to 2:1 or better and is achieved in that the side walls and the front or rear wall of the transport container according to the invention are only slightly inclined relative to the vertical or having a step-like configuration, which means that the transport container according to the invention has a very large filled volume. The formation of slits/grooves in the side walls however at the same time means that the transport containers can be placed deep inside each other.

Yet another advantage of the transport container according to the invention consists in the fact that there are no movable parts which can break. In addition the transport container according to the invention is compatible with other transport containers.

Finally the transport container according to the invention is easy to clean.

Figure 2:
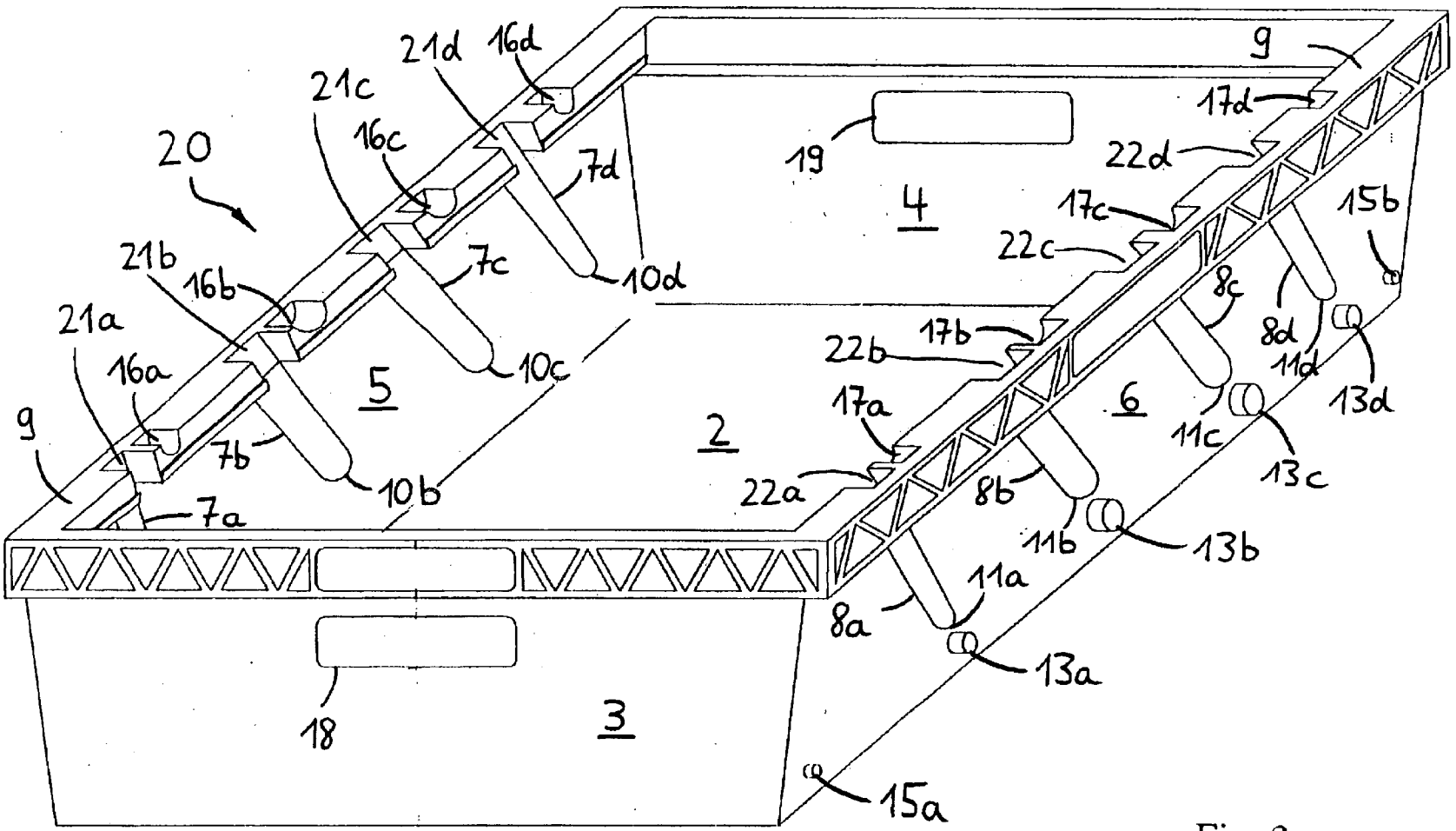
Figure 3:
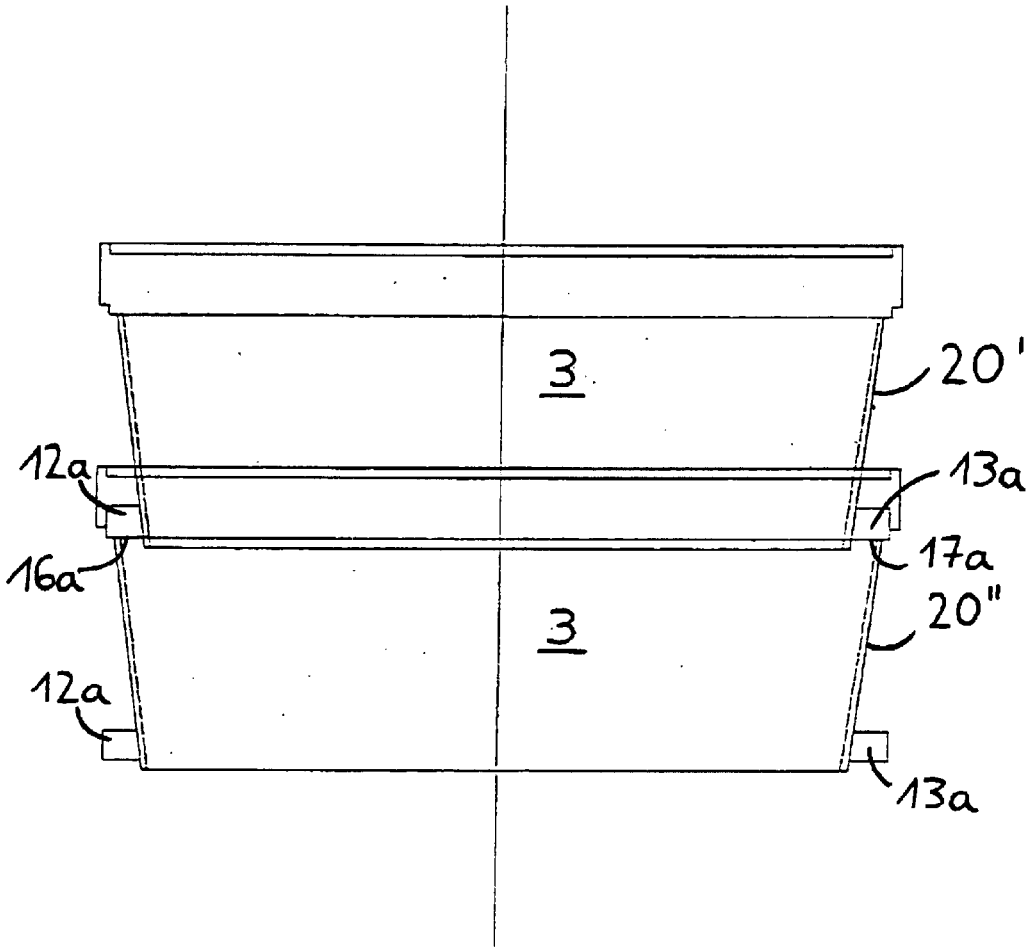
Figure 4:
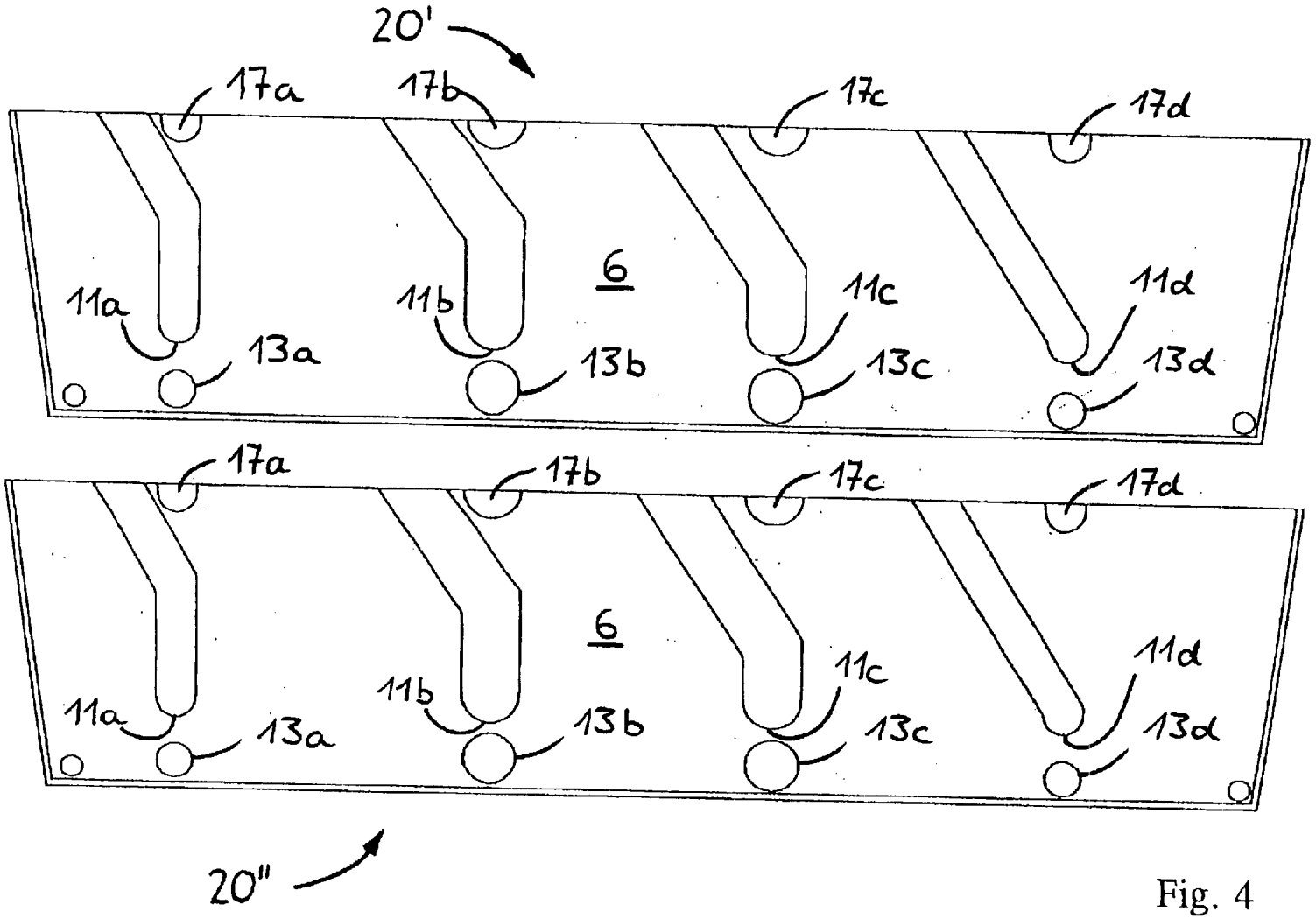
Figure 5:
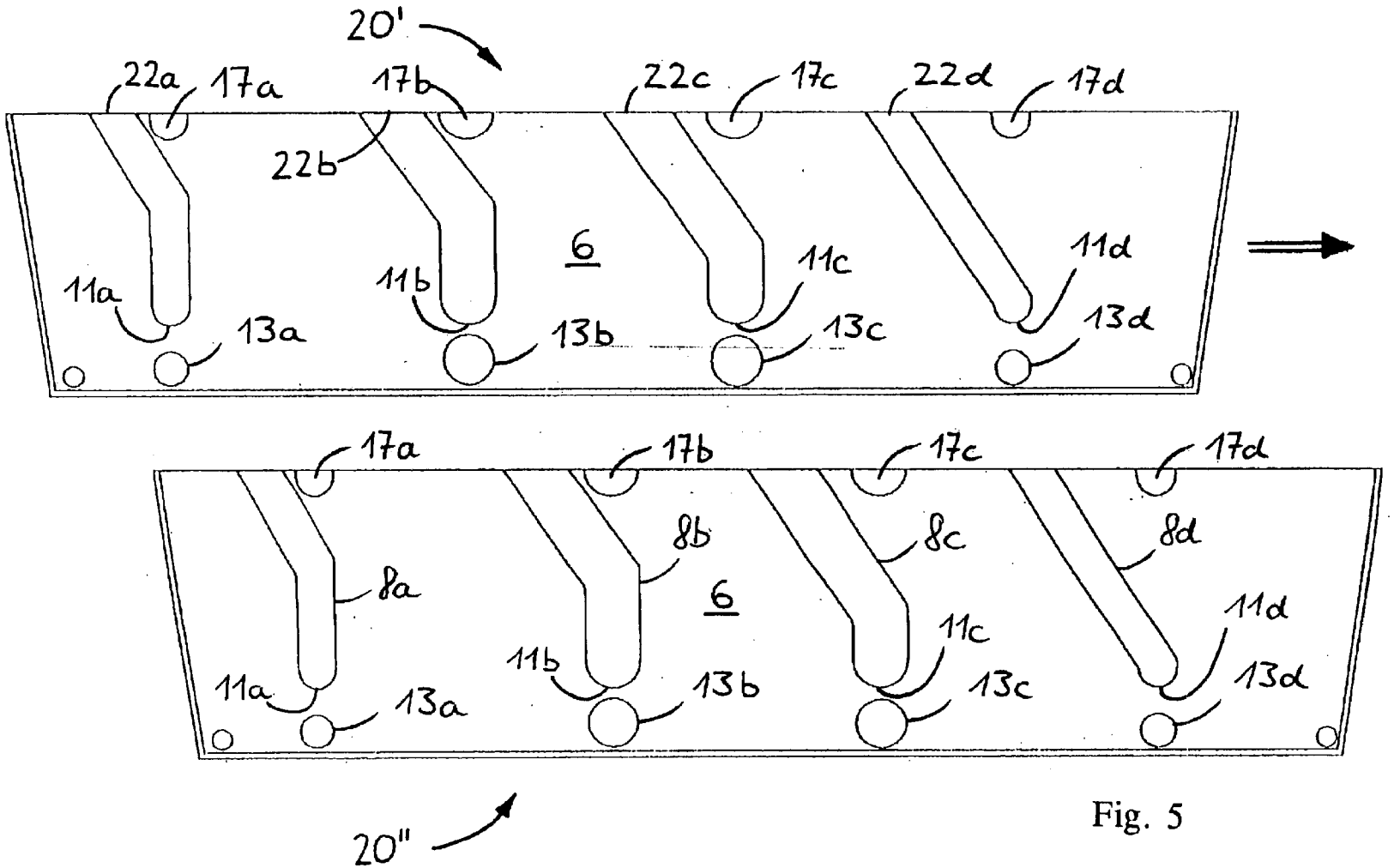
Figure 6:
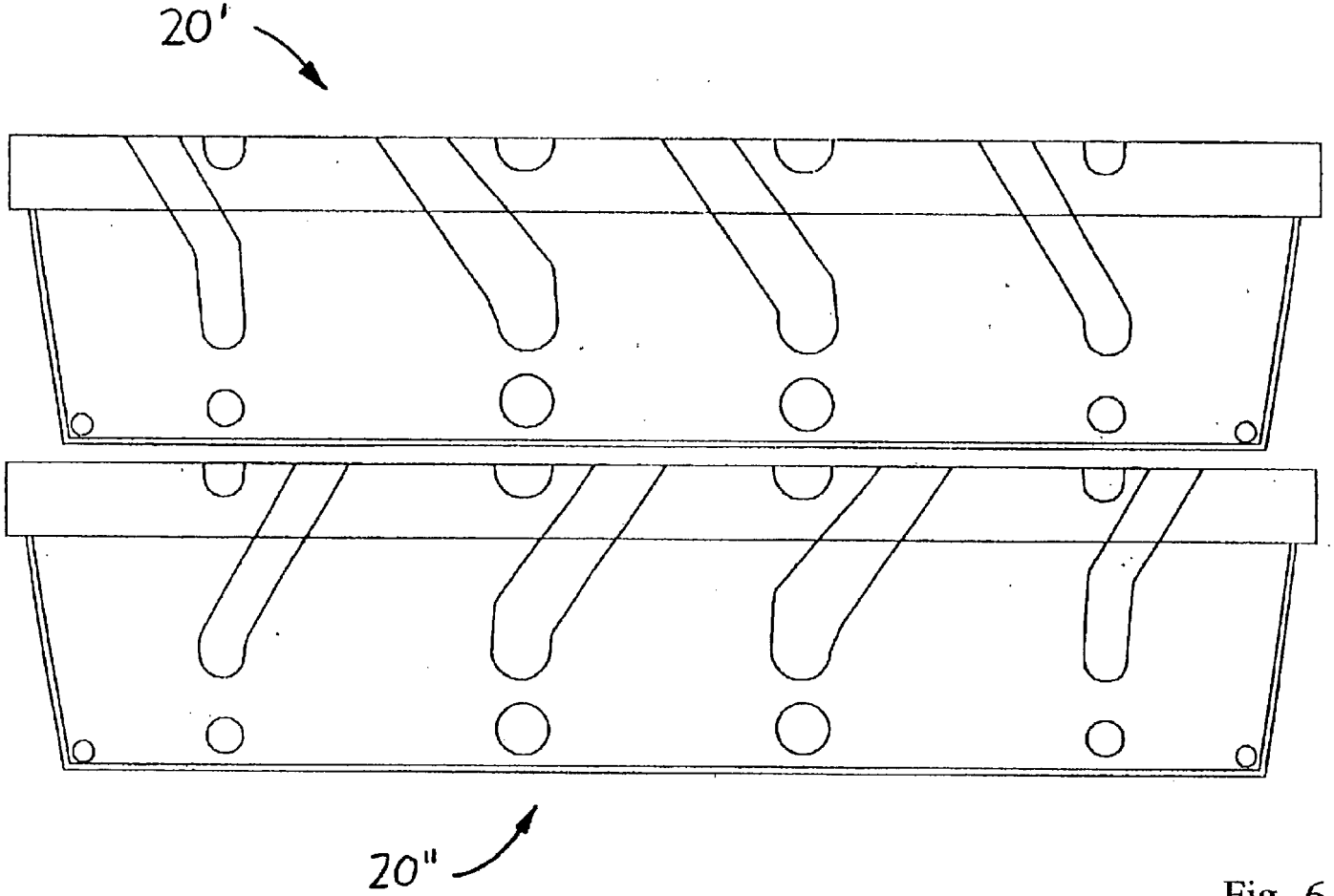
Figure 7:
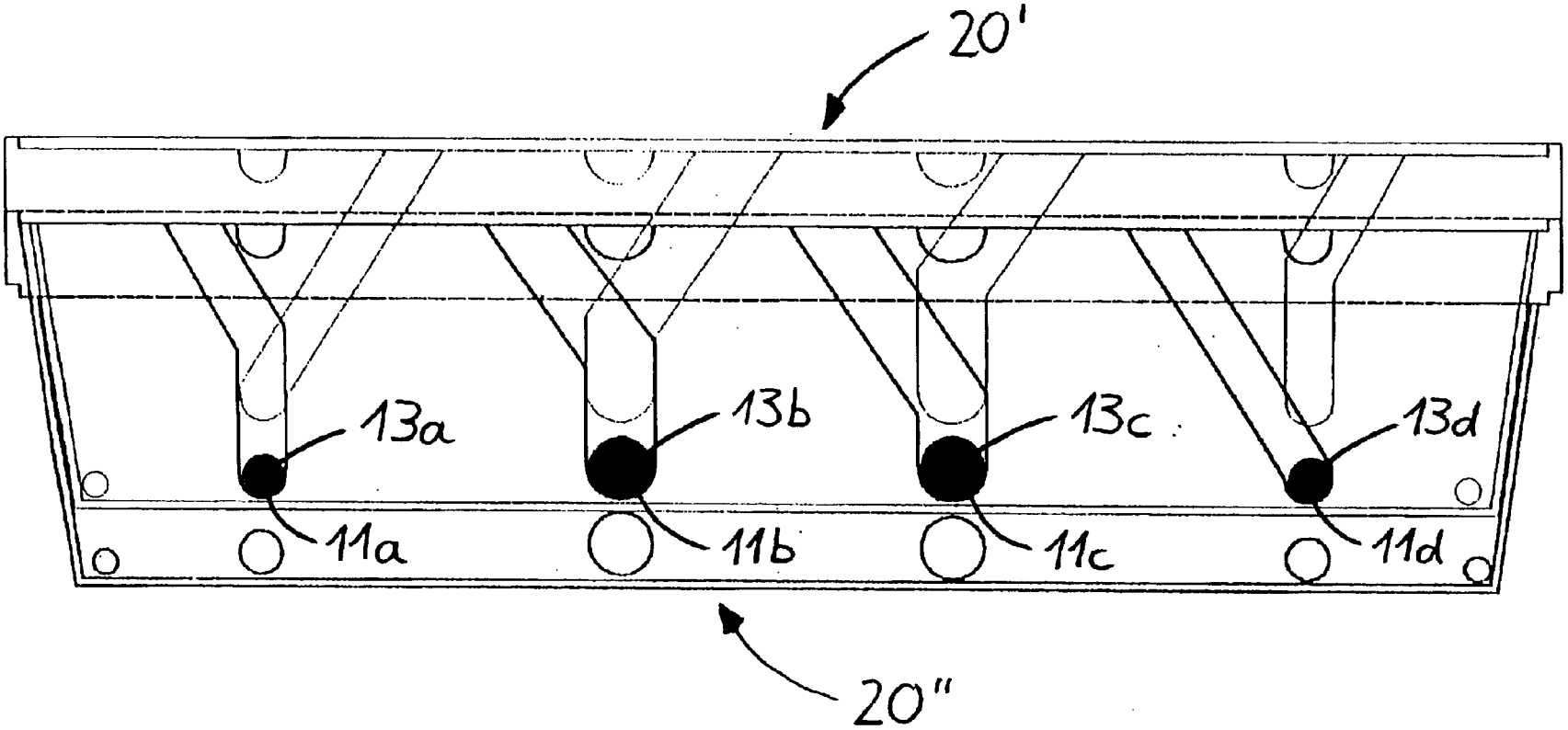
Figure 8:
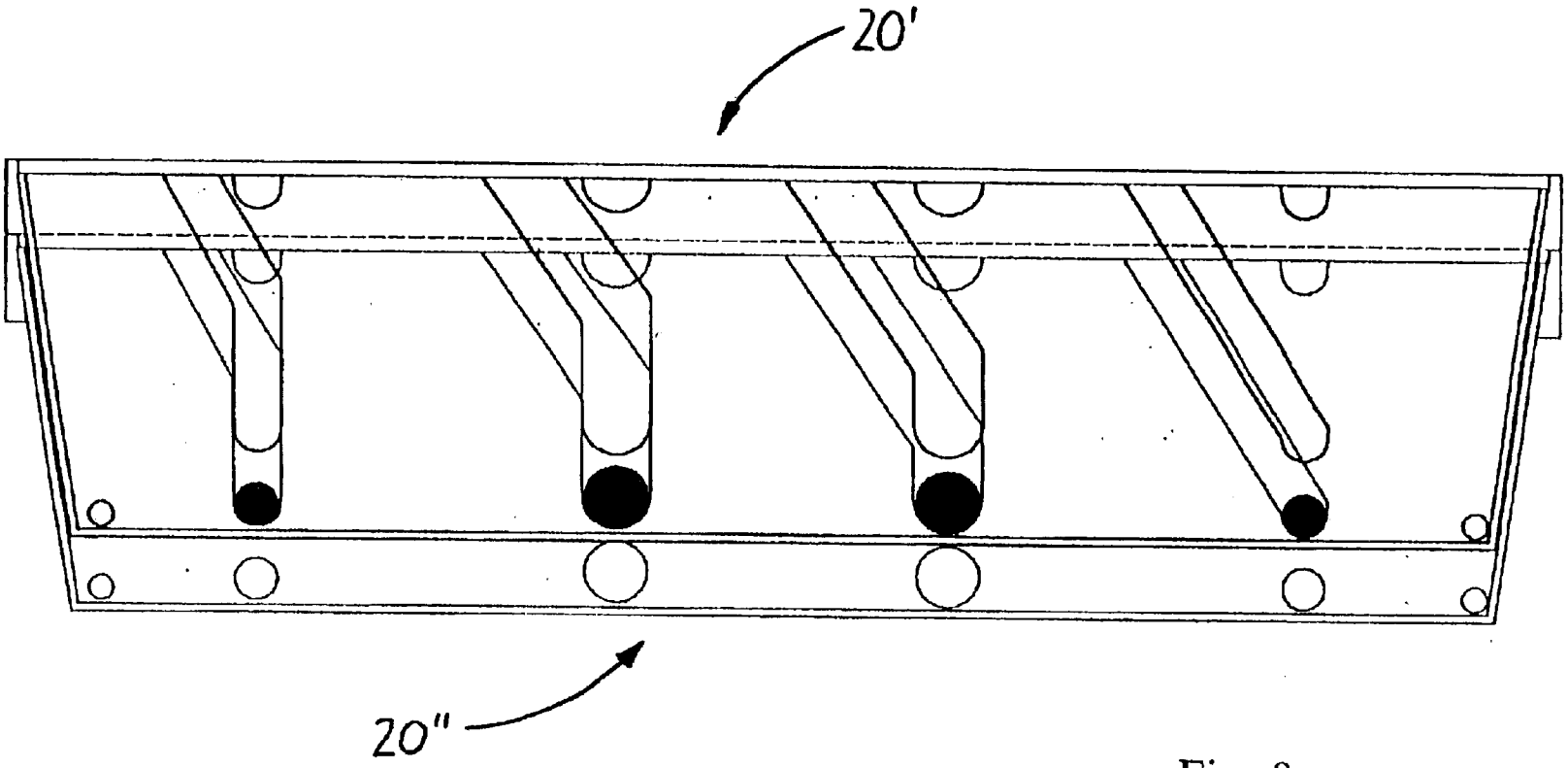
Figure 9:
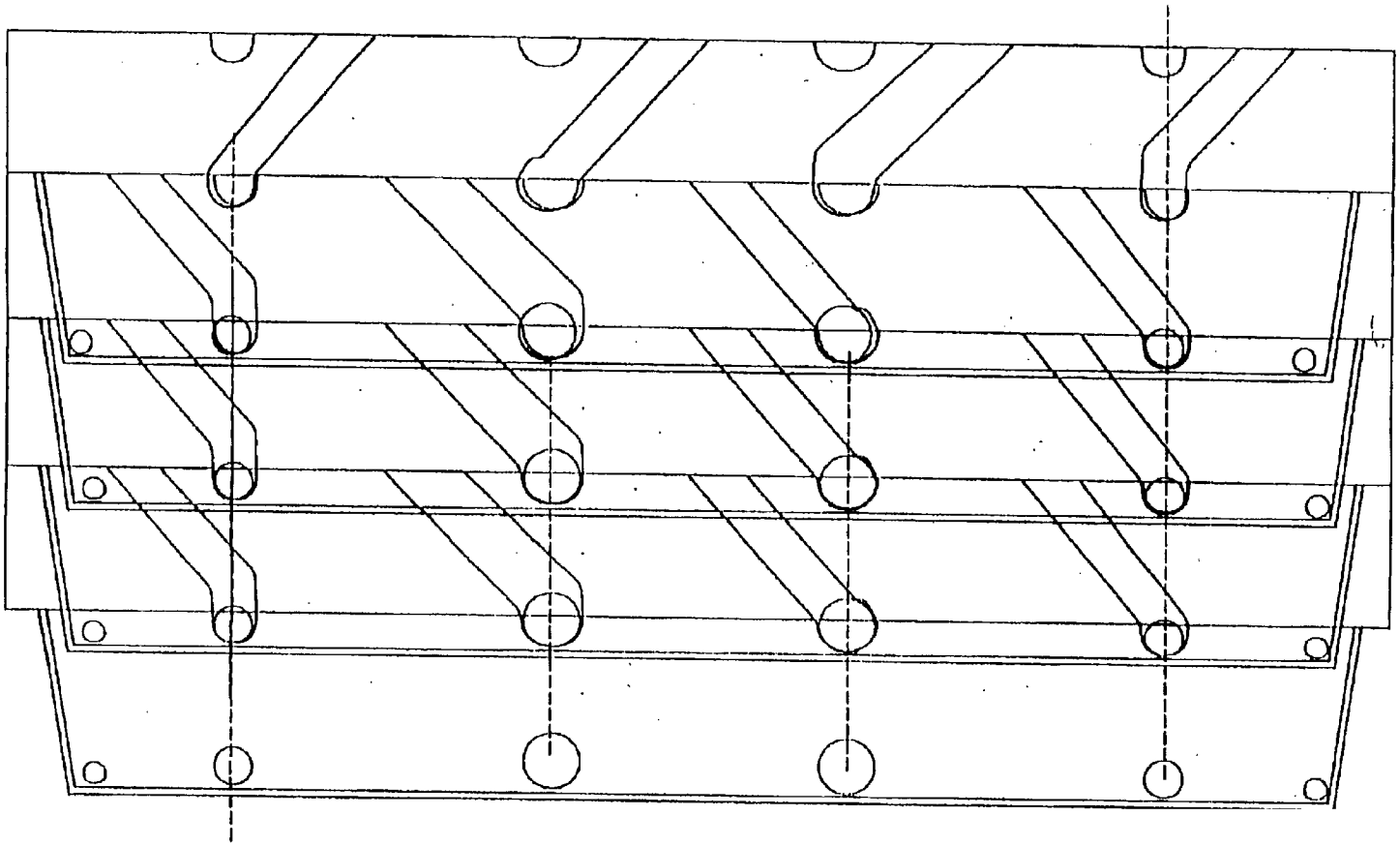
Figure 10:
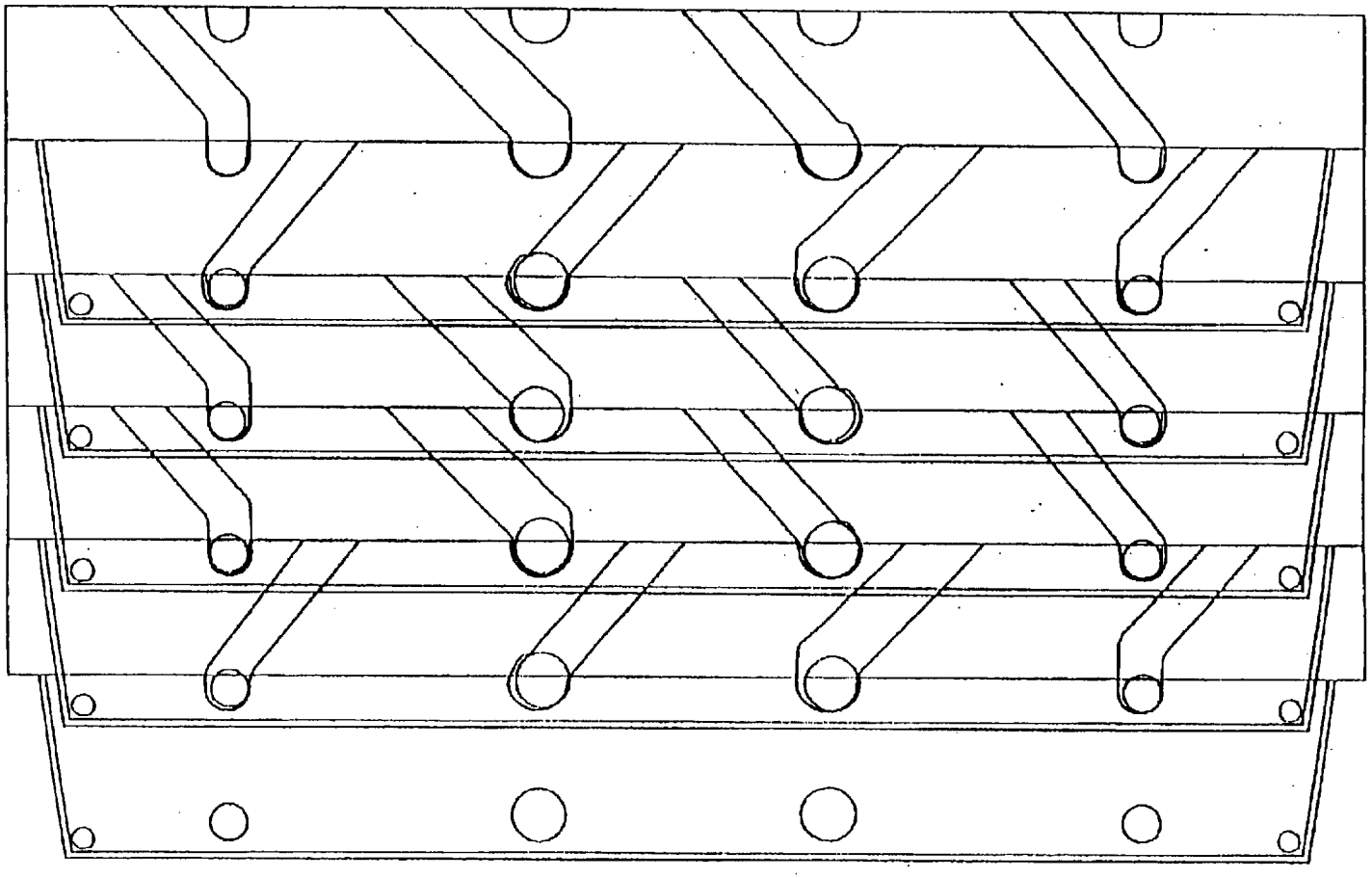
Figure 11:
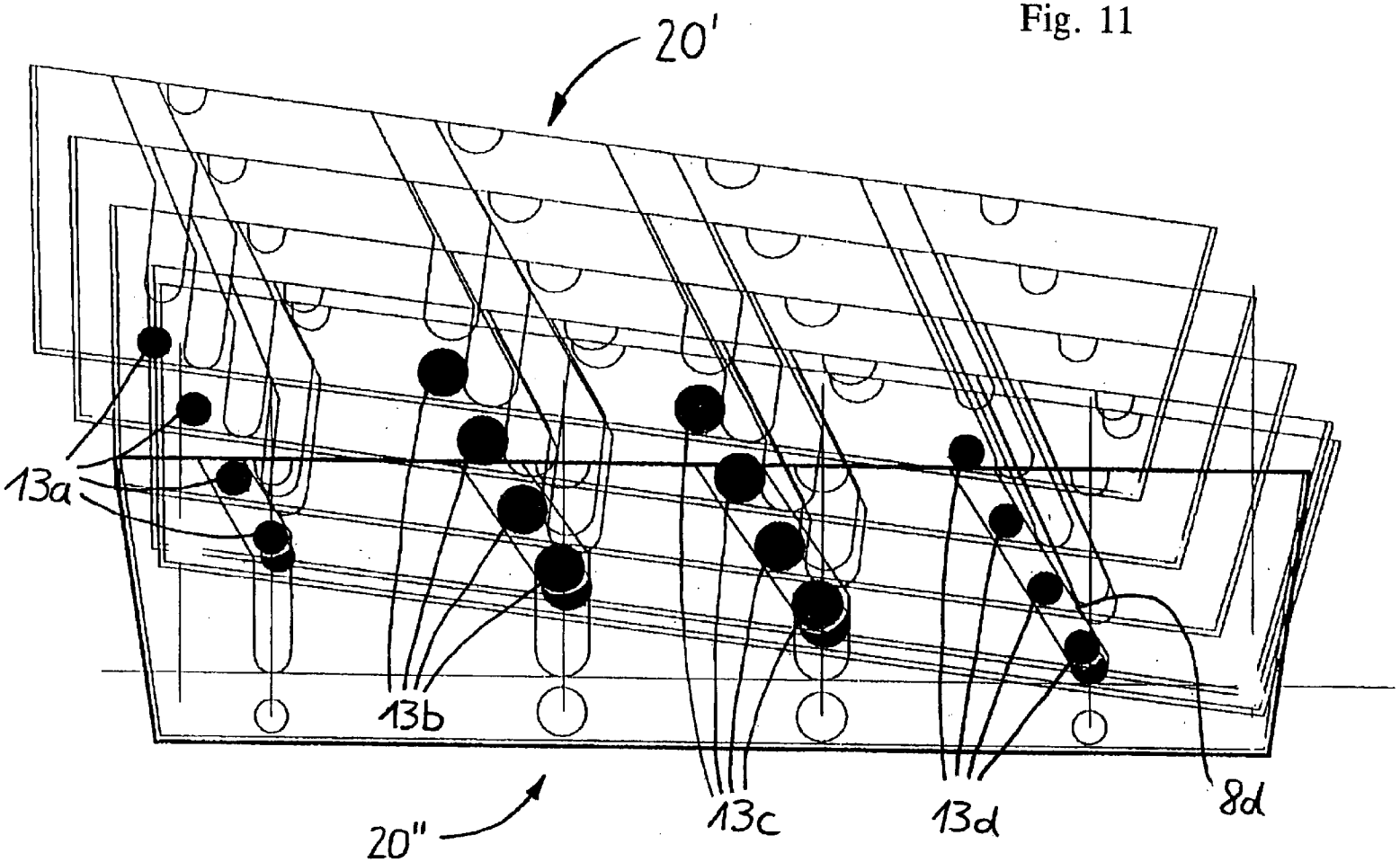
Figure 12:
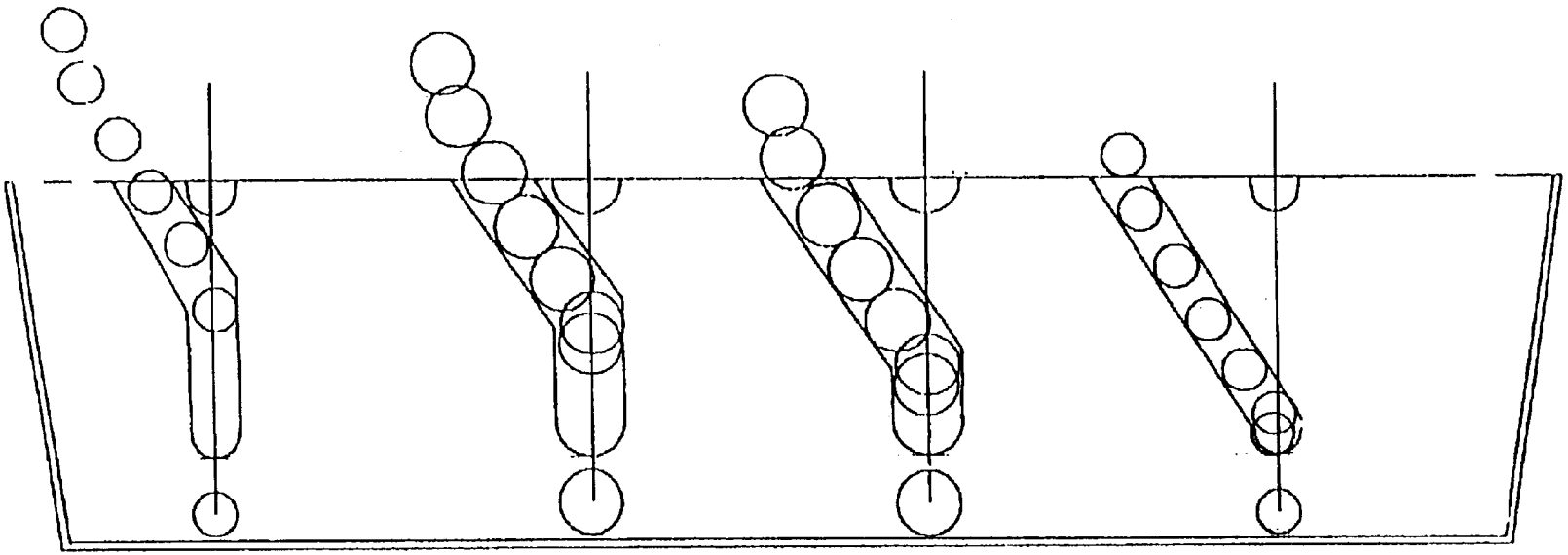
Figure 13:
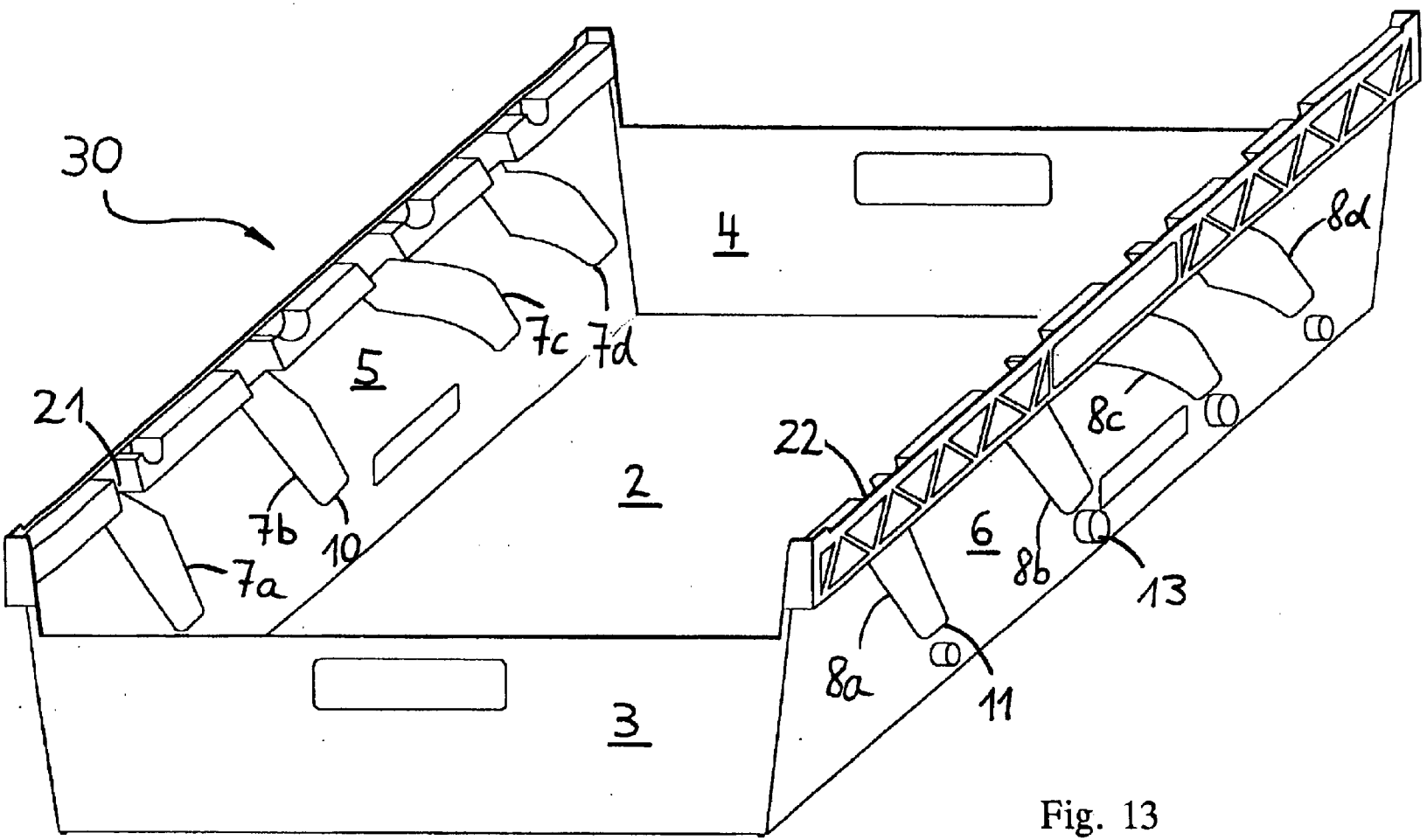
Figure 14:
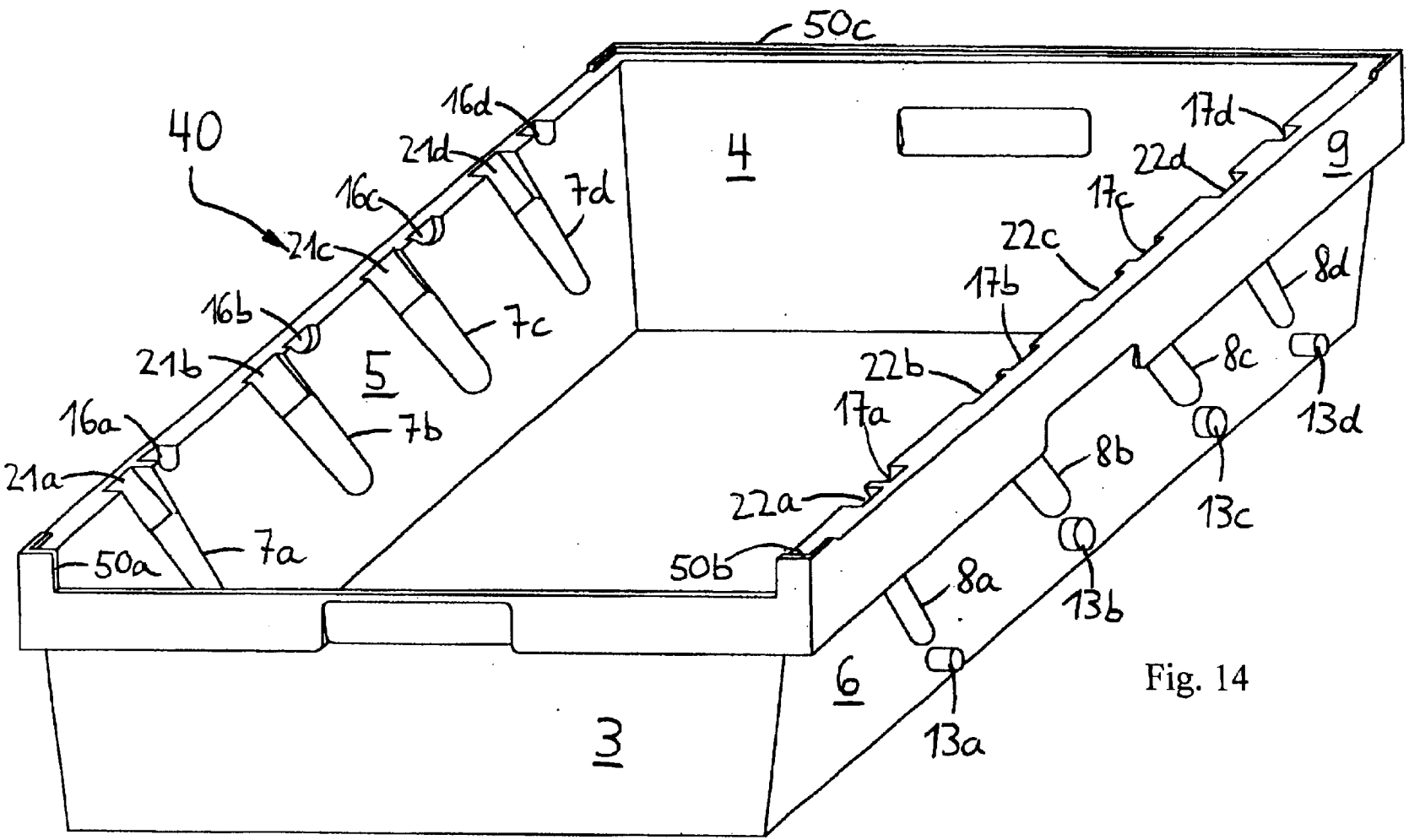
Figure 16:
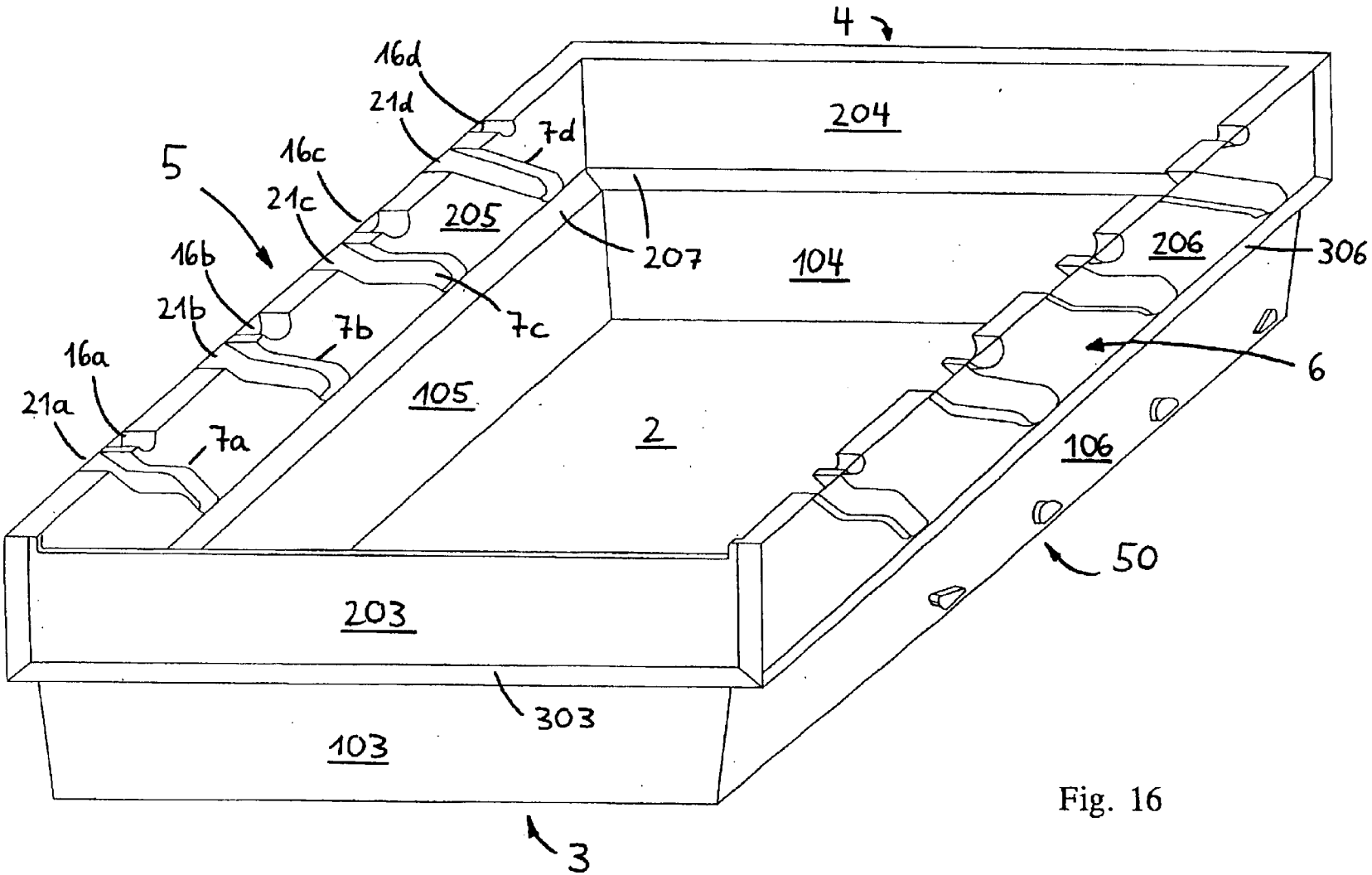
Figure 19:
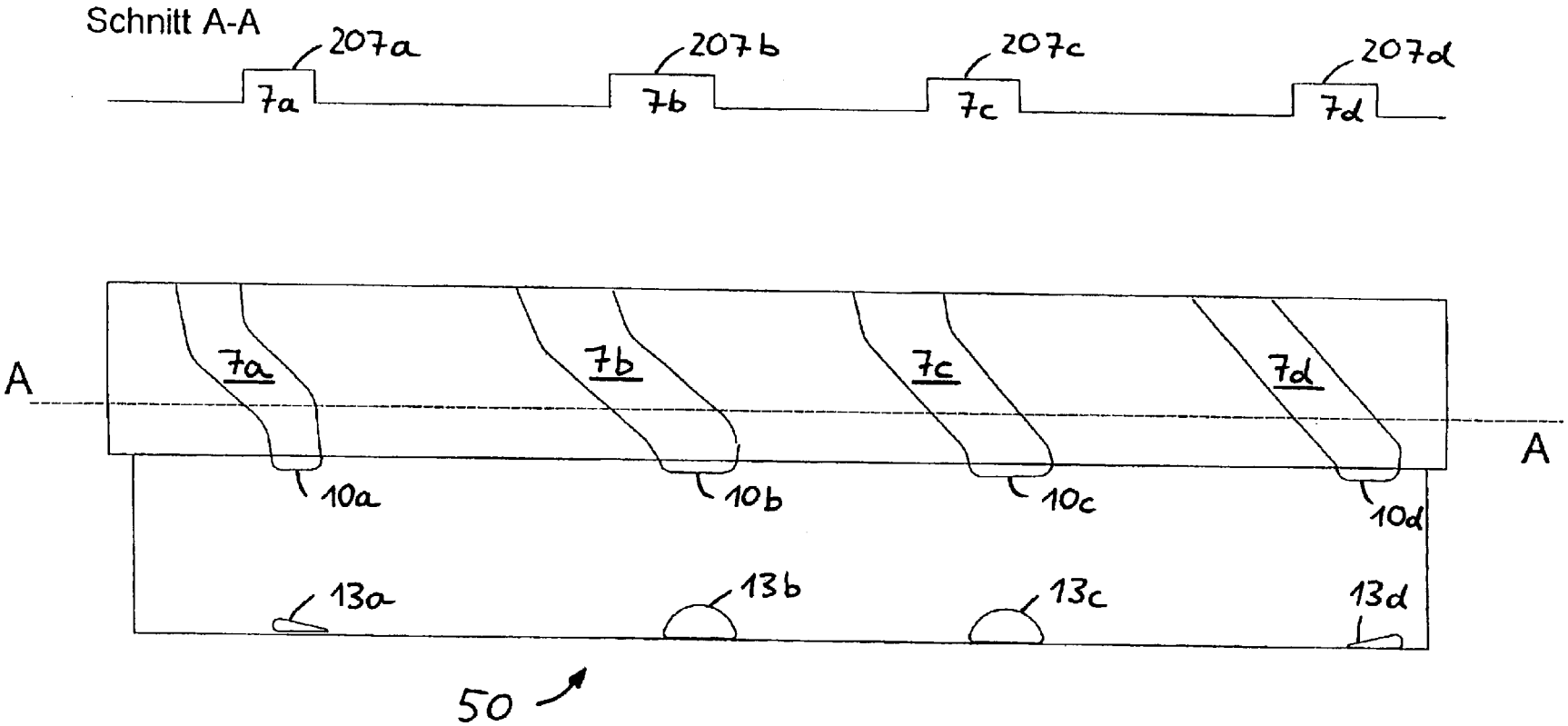

Preferred forms of construction of the invention are now described with reference to the attached drawings; these show:

FIG. 1 a diagrammatic perspective view of a first form of construction of the first embodiment of the stackable/nesting transport container according to the invention, with the shape of the grooves is shown in a diagrammatic way;

FIG. 2 a diagrammatic perspective view of a second form of construction of the first embodiment of the stackable/nesting transport container according to the invention, with the shape of the grooves is shown in a diagrammatic way;

FIG. 3 a diagrammatic front view of two transport containers according to the invention from FIG. 2, represented stacked one on top of the other;

FIG. 4 a diagrammatic side view of two transport containers according to the invention from FIG. 2, arranged one above the other with space between;

FIG. 5 a diagrammatic side view of two transport containers according to the invention, arranged one above the other with space between but slightly offset against each other;

FIG. 6 a diagrammatic side view, similar to FIGS. 4 and 5, of two transport containers according to the invention arranged one above the other with space between and in opposite orientation compared to FIGS. 4 and 5, with the grooves formed in the side walls of the transport containers arranged in opposite orientation;

FIG. 7 a diagrammatic side view of two transport containers according to the invention in opposite orientation, arranged one inside the other, with the grooves formed in the side walls of the transport container arranged in opposite orientation;

FIG. 8 a view, similar to FIG. 7, but with the grooves formed in the side walls arranged in the same orientation;

FIG. 9 a diagrammatic side view of four transport containers according to the invention, arranged one inside the other, with the grooves formed in the side walls of the lower three transport containers arranged in the same orientation;

FIG. 10 a diagrammatic side view of five transport containers according to the invention, arranged one inside the other, with the grooves formed in the side walls of the transport containers arranged in different orientations;

FIG. 11 a diagrammatic representation showing the progressive insertion of an upper transport container into a transport container underneath;

FIG. 12 a diagrammatic representation of how the external (outermost) guide pegs of an upper container are inserted step by step into the grooves of a transport container underneath, to place the upper transport container inside the lower transport container;

FIG. 13 a diagrammatic representation of a third form of construction of the first embodiment of the transport container according to the invention, in which the front wall and-the rear wall are lower in height than the side walls;

FIG. 14 a diagrammatic representation of a form of construction of the second embodiment of the transport container according to the invention;

FIG. 15*a* a top view of the transport container from FIG. 14;

FIG. 15*b* a front view of the transport container from FIG. 14;

FIG. 15*c* a side view of the transport container from FIG. 14, with the groove having different shapes;

FIG. 15*d* a detailed area of the front view of FIG. 14 in enlarged scale;

FIG. 16 a diagrammatic representation of a third embodiment of a transport container according to the invention, in which the side walls, the front wall and the rear wall have a step-like configuration;

FIGS. 17*a* and 17*b* a diagrammatic top view and cross sectional view of the central and outermost guide pegs;

FIG. 18 a diagrammatic cross sectional view of a side wall of the transport container from FIG. 16; and FIG. 19 a diagrammatic and not in correct scale of the transport container shown in FIG. 16 in which the shape of the grooves and guide pegs formed at the side walls are shown, as well as a diagrammatic cross sectional view along line A—A showing the structure of the grooves in the side walls.

FIG. 1 shows a perspective representation of a first form of construction of the first embodiment of the stackable/ nesting transport container 1 according to the invention. The transport container 1 has a bottom 2, that may be a continuous surface, that may as an option have crosspieces underneath to increase the stability of the bottom. Alternatively, however the bottom 2 can also be perforated or have a cellular structure. The bottom 2 is preferably rectangular, but may also have rounded or differently shaped corners. From the bottom 2 of the transport container 1 a front wall 3, a rear wall 4, a left side wall 5 and a right side wall 6 extend to form a receptacle open towards the top. The bottom 2, the front wall 3, the rear wall 4, the left side wall 5 and the right side wall 6 are preferably made from plastic, although other materials can be used. The front wall 3, the rear wall 4, the left side wall 5 and the right side wall 6 are preferably inclined slightly outwards, to enable individual transport containers 1 to be placed one inside the other.

In the inner surface of the left side wall 5 four grooves 7*a,* 7*b,* 7*c* and 7*d* are formed, which are inclined relative to the vertical. In the inner surface of the right side wall 6 corresponding grooves 8*a,* 8*b,* 8*c* and 8*d* are formed, that are inclined to the vertical in the same arrangement as the grooves 7*a,* 7*b,* 7*c* and 7*d* in the inner surface of the left side wall 5. The grooves 7*a*–7*d* and 8*a*–8*d* are shown in a diagrammatic representation; the special way in which these individual grooves are inclined will be described in detail below.

On the upper edge of the front wall 3, the rear wall 4, the left side wall 5 and the right side wall 6 there is a broad circumferential edge/rail 9, which preferably has a rectangular cross-section. Alternatively it is possible that only the upper edges of the left side wall 5 and the right side wall 6 are formed with such a rail 9 or such a broad edge. The rail 9 on the upper edge of front wall 3 and rear wall 4 serves preferably to increase the stability of the transport container 1.

As can be clearly seen in FIG. 1, the grooves 7*a*–7*d* of the left side wall 5 and the grooves 8*a*–8*d* of the right side wall 6 extend upwards to the upper surface of the rail 9 and are closed at bottom, forming groove stops 10*a*–10*d* at the lower end of grooves 7*a*–7*d* and groove stops 11*a*–11*d* (not shown) at the lower end of grooves 8*a*–8*d*. The groove stops 10*a*–10*d* and 11*a*–11*d* all lay in one horizontal plane.

On the outer surface of the left side wall 5 there are four guide pegs 12*a*–12*d* (not shown), and on the outer surface of the right side wall 6 there are four guide pegs 13*a*–13*d*. These guide pegs are preferably formed in the lower area of the outer surface of the side walls at the level of the bottom or just above it, and also all lie in one horizontal plane. The guide pegs preferably have a round cross-section but can also have a polygonal cross-section, extend in a horizontal direction and are preferably rounded off at their outer ends. In addition, on the outer surface of the left side wall 5, at its ends near to the front wall 3 and rear wall 4 respectively, at the level of the bottom 2 there are retaining pegs 14*a,* 14*b* (not shown) and on the outer surface of the right side wall 6, at its ends near to the front wall 3 and rear wall 4 respectively, at the level of the bottom 2 there are also retaining pegs 15*a,* 15*b*.

In the upper surface of the rail 9 of the left side wall 5 and the right side wall 6 there are also four recesses 16*a*–16*d* and 17*a*–17*d* respectively. The recesses preferably have cross-section or a cross-section that matches the cross-section of the guide pegs. The function of the grooves, guide pegs and recesses is described in detail below.

FIG. 2 shows a second form of the first embodiment of the stackable/nesting transport container 20, with the same reference numbers being used to designate the same elements in both figures.

The essential difference between the stackable transport container 1 of the first form of construction from FIG. 1 and the stackable transport container 20 of the second form of construction from FIG. 2 consists in the fact that the grooves 7*a*–7*d* in the left side wall 5 and the grooves 8*a*–8*d* in the right side wall 6 extend completely through the side walls, thus forming slits or cuts. In the description of the following FIGS. 3 to 13, reference will still be made to grooves, both with respect to the grooves in these figures that do not go through the wall, as in FIG. 1, and also grooves that do go through the wall, as in FIG. 2. The advantage of the grooves going through the wall (slits) is that the material of the side walls can be thinner and the side walls do not need to be so sharply inclined. If for example it is necessary for the transport container to form a watertight trough, then it is necessary to use grooves that do not go through the walls.

FIG. 13 shows a third form of construction of the transport container 30 according to the invention. The only difference between this container and the transport containers from FIGS. 1 and 2 is that the front wall 3 and the rear wall 4 are smaller in height than the side walls 5 and 6. The advantage of this shortened side or rear wall 3, 4 consists in the fact that the transport containers can nest deeper inside one another. The grooves can have a form as in FIG. 1 or in FIG. 2.

As is further to be seen in FIG. 2, the grooves 7*a*–7*d* and 8*a*–8*d* do not go through at the level of the rail 9, so that an outer section of the rail 9 remains in the area of the grooves, to increase the stability of the transport container 20. Otherwise, the construction of the transport container 20 is similar to that of the transport container 1. In the front wall 3 and the rear wall 4, there may preferably be openings 18, 19 which are designed to make it easier to grasp and carry the container 20 with the hands. Further, there may be additional openings in the side wall below the groove or between the grooves. The openings in the front wall, the rear wall and/or both side walls can however also be provided in the transport containers of FIGS. 1 and 13.

FIG. 3 shows a front view of two transport containers 20', 20", that are stacked one on top of the other. This stacking arrangement, with one container on top of the other, is preferred when the transport containers are filled with product. As FIG. 3 clearly shows, the guide pegs 12*a–d* on the left side wall 5 of the upper transport container 20' rest in the recesses 16*a–d,* which are formed in the rail 9 of the lower transport container 20". Similarly, the guide pegs 13*a–d* formed on the right side wall 6 of the upper transport container 20' rest in the recesses 17*a–d,* which are formed in the rail 9 of the lower transport container 20". This ensures that the transport container 20' will not slip out of place relative to the lower transport container 20". In the same way further transport containers 20 can be stacked on top of the upper transport container 20'.

It is clear that the distances between the individual guide pegs 12*a–d* and 13*a–d* respectively are in each case equal to the distances between the corresponding recesses 16*a–d* and 17*a–d* respectively. It is further clear that because of the method of representation in FIG. 3 only the front guide pegs 12*a* and 13*a,* and the front recesses 16*a* and 17*a* can be seen.

FIG. 4 shows a side view of two transport containers 20' and 20", positioned one above the other, in order to be stacked one on top of the other. However for clarity of representation, the rail 9 on both the transport containers 20', 20" has been omitted. FIG. 4 clearly shows that the guide pegs 13*a–d* on the visible right side wall 6 of the upper transport container 20' in each case have the same distance between them as the associated recesses 17*a–d* of the transport container 20" underneath. The same of course also applies to the distances between the guide pegs 12*a–d* on the left side wall 5 (not shown) of the upper container 20' and the distances between the corresponding recesses 16*a–d* in the upper edge of the left side wall 5 of the transport container 20" underneath. In this way it can be ensured that in the stacked position all the guide pegs 12*a–d* and 13*a–d* of the upper transport container 20' can engage directly with the corresponding 16*a–d* and 17*a–d* respectively, of the transport container underneath, when the upper transport container 20' and the lower transport container 20' are situated in precise vertical alignment relative to one another.

The distance between the guide pegs 13*a* and 13*b* is preferably equal to the distance between the guide pegs 13*c* and 13*d;* this distance is preferably not the same as the distance between the guide pegs 13*b* and 13*c*. The same applies to the guide pegs 12*a*–12*d* on the left side wall of the transport container. The distances between the recesses 16*a–d* and 17*a–d* respectively are corresponding. Consequently the distances between the guide pegs and the recesses are designed to be in mirror symmetry to each other. In this way two or more guide pegs can only engage with the associated recesses if the upper transport container is placed in precise vertical alignment to the lower transport container. This means that the upper transport container can be pushed more easily onto the lower transport container, without the guide pegs being able to engage with the wrong recesses during the pushing movement. If, when being pushed on, a guide peg is in alignment with the wrong recess, it cannot however engage with this recess, as the upper transport container will be held on the upper edge of the rail by the other guide pegs that because of the different distances explained above cannot be in alignment with the recesses underneath. Only when all the guide pegs of the upper transport container are in alignment with all the corresponding recesses of the lower transport container can the upper transport container be lowered, which means that all the guide pegs of the upper transport container engage simultaneously with the appropriate recesses of the lower transport container.

FIGS. 1–13 show the transport containers each with four guide pegs, four recesses and four grooves on each side of the transport container. The distance between the guide pegs 12*a* and 12*b* (and 13*a* and 13*b*) is equal to the distance between the guide pegs 12*c* and 12*d* (and 13*c* and 13*d*), for example 15 cm. The distance between the guide pegs 12*b* and 12*c* (and 13*b* and 13*c*) is different and amounts, for example, to 20 cm. The distances between the associated recesses are corresponding. Consequently the distances between the guide pegs and the recesses are in mirror symmetry to each other. It is clear that it is also possible to have a different number of guide pegs, recesses and grooves. Thus for example it is possible to have two, three or more than four guide pegs, recesses and grooves respectively on each side of the transport container according to the invention. With regard to the distance between the guide pegs and the recesses it is only important that the guide pegs of the upper transport container engage with the recesses in the lower transport container, when the two transport containers are in the stacking position relative to one another. It is moreover important that the distances between the guide pegs and the recesses respectively are in each case selected so that the guide pegs of the upper transport container engage with the recesses of the lower transport container in both alignments of the transport container to each other, i.e. in the alignment shown in FIG. 4 and in the alignment turned round 180° (see FIG. 6), if both transport containers are stacked on top of one another in the correct position relative to each other.

As is also shown clearly by FIG. 4, the distances between the lower groove stops 11*a–d* are equal to the distances between the associated guide pegs 13*a–d*. Preferably, the groove stops 11*a–d* are in vertical alignment with the associated guide pegs 13*a–d*. The same also of course applies to the groove stops 10*a–d* and the guide pegs 12*a–d* on the left side wall 5 (not shown) of the transport container. It is clear that these conditions also apply to a transport container that has a different number of guide pegs and grooves, as explained above.

FIG. 4 also shows that the distances between the upper openings of the grooves 7*a–d* and 8*a–d* differ from the distances between the associated guide pegs 12*a–d* and 13*a–d* respectively. This prevents the guide pegs 12*a–d* and 13*a–d* respectively, when the lower transport container 20" and the upper transport container 20' are each placed in a horizontal position, from all becoming vertically aligned with one another. If the upper transport container 20' in FIG. 4 is pushed from left to right in a horizontal position onto the transport container 20" underneath, in each case only one or two of the guide pegs 12*a–d* and 13*a–d* on the left side wall 5 and on the right side wall 6 respectively, of the upper transport container 20' can come into alignment with an upper opening of the grooves 7*a–d* and 8*a–d* of the left side wall 5 and the right side wall 6 respectively, of the lower transport containers 20"; the other guide pegs slide on the upper edge of the rail. This ensures that the upper transport container 20', when pushed from left to right on the transport container 20' underneath, so that the guide pegs 12*a–d* and 13*a–d* slide along the upper edge of the rail 9, cannot inadvertently get into the nesting position in relation to the lower transport container 20", as the guide pegs 12*a–d* and 13*a–d* cannot all simultaneously come into alignment with the upper openings of the grooves 7*a–d* and 8*a–d* respectively, and thus cannot all simultaneously slip into the grooves 7*a–d* and 8*a–d* respectively. The way in which the upper transport container 20' can be brought to nest inside the lower transport container 20" is described in detail below.

FIG. 5 shows in detail how the upper transport container 20' is pushed onto the lower transport container 20" with reference to FIG. 4. As can be seen in FIG. 5, the right guide peg 13*d* on the right side wall 6 of the upper transport container 20' is located in alignment with the upper opening of the groove 8*d* in the right side wall 6 of the lower transport container 20" and could easily slide into the groove 8*d* by virtue of its own weight. However this is prevented by the fact that the other three guide pegs 13*a, b* and *c* on the right side wall 6 of the upper transport container 20' are not in alignment with the upper openings of their associated grooves 8*a,* 8*b* and 8*c* in the right side wall 6 of the lower transport container 20", but instead are held and supported on the upper edge/rail 9 or the right side wall 6 of the lower transport container 20". If the upper transport container 20' is pushed still further to the right, the guide peg 13*d* of the upper transport container 20' comes to rest on the upper edge of the rail 9 of the right side wall 6 of the lower transport container 20", the guide peg 13*c* of the upper transport container 20' comes into alignment with the upper opening of the groove 8*c* of the lower transport container 20", whilst the guide pegs 13*a* and 13*b* of the upper transport container 20' come to rest on the upper edge of the rail 9 of the right side wall 6 of the lower transport container 20". As already explained above, the distances between the guide pegs of the upper transport containers and the distances between the recesses in the lower transport container 20" are preferably selected so that the guide pegs of the upper transport container 20' only engage with the recesses of the lower transport container 20", when all four guide pegs of the upper transport container 20' are in vertical alignment with the associated four recesses of the lower transport container 20". In this case it cannot happen that during the pushing of the upper transport container 20' onto the lower transport container 20", for example three guide pegs 13*b, c* and *d* of the upper transport container engage with the recesses 17*a, b* and *c* of the lower transport container. This considerably simplifies the pushing of the upper transport container 20' onto the lower transport container 20".

It is clear that the above considerations, which because of the representation in FIGS. 5 and 6 relate in each case to the right side walls 5 of the upper transport container 20', and the lower transport container 20", also apply in each case to the left side walls 6 of the upper transport container 20' and the lower transport container 20", as the transport containers have a symmetrical construction in each case.

FIG. 6 is a representation, similar to that in FIGS. 4 and 5, in which the alignment of the grooves of the upper transport container 20' (which are directed from the right at the bottom to the left at the top) differs from the alignment of the grooves of the lower transport container 20" (which are directed from the left at the bottom to the right at the top). It can also be seen here that the guide pegs of the upper transport container are in alignment with the associated recesses of the lower transport container. The considerations relating to FIG. 5 on the pushing of the upper transport container 20' onto the lower transport container 20" also of course apply to the orientation of the two transport containers 20', 20" shown in FIG. 6.

FIG. 7 shows the case in which the upper transport container 20' is nesting inside the lower transport container 20". Here it can be seen that the distances between the guide pegs 13*a–d* of the upper transport container are equal to the distances between the groove stops 11*a–d* of the lower transport container 20", so that the guide pegs of the upper transport container 20', sit precisely in the lower closed end of the grooves 8*a–d* of the lower transport container 20", and fit precisely against the groove stops 11*a–d* of the lower transport container 20". FIG. 7 shows the case in which the alignment of the grooves of the upper transport container 20' is different from the alignment of the grooves of the lower transport container 20".

FIG. 8 shows the case in which the upper transport container 20' is nesting inside the lower transport container 20". Here the grooves of the upper transport container are in the same alignment as the grooves of the lower transport container, as this is also shown in FIGS. 4 and 5. In this case also, the guide pegs of the upper transport container 20' engage precisely with the groove stops of the lower transport container 20".

FIGS. 9 and 10 show several transport containers nesting one inside the other, with the orientation of these transport containers differing from one another. It is clearly shown that it is completely immaterial, in which orientation the transport containers are placed one inside the other. Unlike some transport containers according to the state of the art, with the transport container according to the invention, no rotation around 180° is necessary; in addition no movable parts are necessary.

FIG. 11 shows schematically how the upper transport container 20' can be placed inside the lower transport container 20". The following description again relates only to the right side wall 6 of the upper transport container 20' or the lower transport container 20" respectively, but it is of course clear that these considerations also apply in each case to the left side walls 5 of the upper transport container 20' and the lower transport container 20", or the associated grooves, groove stops and guide pegs, which are arranged on the left side wall 5 of the upper/lower transport container 20', 20".

It can be seen that the upper transport container 20' is placed inside the lower transport container 20" in a position sloping downwards. First of all the front guide pegs (FIG. 11 shows only the right guide peg 13*d* of the upper transport container) are inserted into the upper openings of the front groove 8*d* into the groove 8*d* of the lower transport container. Because of the sloping position of the upper transport container 20' relative to the lower transport container 20", if the front guide peg 13*a* of the upper container 20' is pushed deeply enough into the front groove 8*a* of the lower transport container, the guide peg 13*c* can also be inserted through the upper opening of the second groove 8*c* into this groove 8*c* of the lower transport container. If the guide pegs 13*d* and 13*c* of the upper transport container 20' are pushed further into their associated grooves 8*d* and 8*c*, then the guide peg 13*b* of the upper transport container 20' comes into alignment with the groove 8*b* of the lower transport container 20" and can be pushed into it. If the upper transport container 20' is inserted further, at some point the guide peg 13*a* of the upper transport container 20' engages with the groove 8*a* of the lower transport container 20" and can be pushed into it.

It is clear that the upper transport container 20' can only be placed inside the lower transport container 20" by means of a kind of plunging movement. As explained above, the upper transport container cannot thus be inadvertently pushed into the lower transport container, preventing the produce inside the lower transport container from being inadvertently damaged.

FIG. 12 once again shows the plunging movement of the upper transport container into the lower transport container, but with the outline of the upper transport container omitted, to enable the progressive movement of the guide pegs of the upper transport container into the grooves of the lower transport container to be represented better.

This way of plunging the upper transport container 20' into the lower transport container 20" also results in increased stability. It also guarantees that transport containers placed one inside the other can be unstacked without difficulty. As already mentioned, the guide pegs are slightly bevelled, which makes it easier to push the guide pegs into the grooves and also facilitates unstacking (manually or automatically).

FIG. 14 shows a form of construction of the stackable/nesting transport container 40 according to the second embodiment of the invention. The difference relative to the transport containers according to the first embodiment from FIGS. 1, 2 and 13 consists in the fact that the grooves 7*a–7d* in the left side wall 5 and the grooves 8*a–8d* in the right side wall 6 extend at an angle to the vertical and have in general all the same shape.

On the upper edge of the front wall 3, the rear wall 4, the left side wall 5 and the right side wall 6 there is a edge/rail 9. The front wall 3 is lower in height than the other three walls. The rail 9 on the upper edge of front wall 3 and rear wall 4 serves preferably to increase the stability of the transport container 40.

As can be clearly seen in FIG. 14, the grooves 7*a–7d* of the left side wall 5 and the grooves 8*a–8d* of the right side wall 6 extend upwards to the upper surface of the rail 9 and are closed at bottom, forming groove stops at the lower end of grooves.

On the outer surface of the left side wall 5 there are four guide pegs 12*a–12d* (not shown), and on the outer surface of the right side wall 6 there are four guide pegs 13*a*–13*d*. The guide pegs preferably have a round cross-section but can also have a polygonal cross-section, extend in a horizontal direction and are preferably rounded off at their outer ends. The two outermost guide pegs 12*a*, 12*d* and 13*a*, 13*b* respectively at the left side wall and at the right side wall are longer and thinner than the central guide pegs 12*b*, 12*c* and 13*b*, 13*c* respectively at the left side wall and the right side wall 5, 6.

In the upper surface of the rail 9 of the left side wall 5 and the right side wall 6 there are also four recesses 16*a*–16*d* and 17*a*–17*d* respectively. The recesses preferably have a semi-circular cross-section or a cross-section that matches the cross-section of the guide pegs. As can be clearly seen in FIG. 14, the outermost recesses 16*a*, 16*d* and 17*a*, 17*d* respectively are deeper and have a smaller diameter for being able to receive the corresponding outermost guide pegs 12*a*, 12*d* and 13*a*, 13*d* respectively. Accordingly, the central recesses 16*b*, 16*c* and 17*b*, 17*c* respectively are more shallow and have a larger diameter for being able to receive the corresponding central guide pegs 12*b*, 12*c* and 13*b*, 13*c* respectively.

In a similar way, the openings of the grooves are shaped to correspond to the shape and dimensions of the respective guide pegs 12*a*–*d* and 13*a*–13*d*. As can be clearly seen in FIG. 14, the openings of the outermost grooves 7*a*, 7*d* and 8*a*, 8*d* respectively are deeper and narrower for being able to receive the respective longer and thinner outermost guide pegs 12*a*, 12*d* and 13*a*, 13*d* respectively. Further, the openings of the central grooves 7*b*, 7*c* and 8*b*, 8*c* respectively are more shallow and wide for being able to receive the shorter and thicker central guide pegs 12*b*, 12*c* and 13*b*, 13*c* respectively.

It is obvious that, when an upper transport container 40 is pushed over a lower transport container 40 in pushing direction, the front outermost longer guide pegs 12*d* and 13*d* slide over the central more shallow groove openings 16*b*, 16*c* and 17*b*, 17*c* respectively and over the openings of the central grooves 7*b*, 7*c* and 8*b*, 8*c* respectively and can only penetrate into the outermost deeper and more shallow recesses 16*d* and 17*d* respectively or into the outermost deeper and more shallow grooves 7*d* and 8*d* respectively.

In FIG. 14, it can also be seen that at the upper surface of the rail 9 (preferably at the outer corners thereof) upward ribs 50*a*, 50*c* and 50*d* are provided. These ribs are arranged to engage with the outer edge of the bottom of a known baker's tray stacked on top of the transport container 40 according to the invention. In particular, these ribs 50*a*, 50*c* and 50*d* are important for the transport container 40 which has a front wall 3 and/or rear wall 4 which is lower in height than the side walls 5, 6 and when the projections on the underside of the bottom of the known upper baker's tray do not engage with the rail of the front wall and/or rear wall of the transport container underneath of the invention. In this case, the ribs 50*a*, 50*c* and 50*d* engage with the outer edge of the bottom of the baker's tray thus preventing that the baker's tray can slide off the rail 9 of the transport container 40 underneath in forward or rearward direction. It is obvious that the ribs 50*a*, 50*c* and 50*d* can also be provided at the respective forms of construction of the transport containers 1, 20 and 40 of first embodiment of the invention.

FIG. 15*a* shows a top view of the transport container 40 of the second form of construction according to the invention. FIGS. 15*b* and 15*c* show a front view and a side view, respectively, of the transport container 40 from FIG. 15*a*, which is provided with grooves as used in the first form of construction, however. FIG. 15*d* shows a detail of the front view from FIG. 15*b* in enlarged scale, to better represent the dimensions of the guide pegs.

FIG. 16 shows a perspective representation of a third and most preferred form of construction of the first embodiment of the stackable/nesting transport container 50 according to the invention. This transport container 50 has a bottom 2, that may be a continuous surface, that may as an option have crosspieces underneath to increase the stability of the bottom. Alternatively, however the bottom 2 can also be perforated or have a cellular structure. The bottom 2 is preferably rectangular, but may also have rounded or differently shaped corners. From the bottom 2 of the transport container 50 a front wall 3, a rear wall 4, a left side wall 5 and a right side wall 6 extend to form a receptacle open towards the top. The bottom 2, the front wall 3, the rear wall 4, the left side wall 5 and the right side wall 6 are preferably made from plastic, although other materials can be used. The front wall 3, the rear wall 4, the left side wall 5 and the right side wall 6 each have a substantially vertically extending lower wall portion 103, 104, 105 and 106, and a substantially vertically extending upper wall portion 203, 204, 205 and 206. As can be seen in FIG. 16, the lower wall portions 103–106 extend more inwardly, and the upper wall portions 203–206 extend more outwardly, so that the horizontal cross section plane extending between the lower wall portions is smaller than the horizontal cross section plane extending between the upper wall portions. The lower and upper wall portions are connected by means of a slightly inclined outwardly extending connecting portion 207 which extends inclined outwardly and upwardly from the upper edge of the lower wall portions to the lower edge of the upper wall portions. Substantially at the level of the connecting portion 207, an outwardly extending horizontal flange (303 and 306 in FIGS. 18 and 19) is formed at the outer surface of the side walls and, if desired, at the front wall and/of the rear wall. When two transport containers are placed inside one another, the downward surface of the flange 303, 306 of the upper transport container lies on the upward surface of the upper wall portions of the side walls and, if present, of the front wall and/of the rear wall of the transport container underneath. By means of such a construction, the stability of the stack is increased and the load of the guide pegs of the upper transport container supported on the groove stops of the transport container underneath is reduced.

The transport container 50 shown in FIG. 16 preferably has a total length of about 60 cm and a total width of about 40 cm, wherein the lower wall portions 103–106 preferably have a height of about 8 cm, and the upper wall portions 203–206 preferably have a height of about 7 cm so that the total height of the transport container is about 15 cm. The grooves 7*a*–7*d* and 8*a*–8*d* are formed through the upper wall portions 203–206 and between outwardly protruding wall sections 207*a*–207*d* as shown in the cross sectional view of FIG. 19. A possible design of the grooves 7*a*–7*d* is shown in FIG. 19, for example, with the grooves 8*a*–8*d* in the opposed side wall are identical. In this way, by means of such a construction of the grooves 7*a*–7*d* and 8*a*–8*d* a plurality of strengthening ribs are formed on the outside of the upper wall portions 205 and 206 for increasing the stability of the transport container 50.

As shown in FIGS. 17*a*, 17*b* and 19, the guide pegs 12*a*–12*d* and 13*a*–13*d* have different shapes. The two outer guide pegs 12*a*, 12*d*, 13*a* and 13*d* have a drop shape, and the inner guide pegs 12*b*, 12*c*, 13*b* and 13*c* have a substantially semi-circular shape. The outermost ends of all guide pegs are provided with downwardly extending protrusions (213*a* and 213*b* in FIGS. 17*a* and 17*b*, for example) adapted for engaging with an rib or edge (406 in FIG. 18) formed at the upper surface of the upper wall portions of the side walls. These protrusions can also engage with the support surface of the groove stops (10*a*–10*d* in FIG. 19) when both transport containers are placed inside one another. By means of the drop shape (see guide peg 13*a* in FIG. 17*b*) or by means of the semi-circular shape (see guide peg 13*b* in FIG. 17*a*) of the guide pegs insertion of the guide pegs into the grooves is facilitated.

Preferably, the guide pegs 13*a* and 13*b* have a distance of about 13 cm. Preferably, the guide pegs 13*b* and 13*c* have a distance of about 16 cm. Preferably, the guide pegs 13*c* and 13*d* have a distance of about 13 cm. The guide pegs 12*a*–12*d* on the opposite side wall have the same distances. Preferably, the recesses 16*a* and 16*b* have a distance of about 13 cm. Preferably, the recesses 16*b* and 16*c* have a distance of about 16 cm. Preferably, the recesses 16*c* and 16*d* have a distance of about 13 cm. The recesses 17*a*–17*d* on the opposite side wall have the same distances. Preferably, the groove openings 21*a* and 21*b* have a distance of about 13 cm. Preferably, the groove openings 21*b* and 21*c* have a distance of about 15 cm. Preferably, the groove openings 21*c* and 21*d* have a distance of about 10.5 cm. The groove openings 22*a*–22*d* on the opposite side wall have the same distances.

What is claimed is:

1. Stackable transport container (1; 20; 30; 50), with a bottom (2), a front wall (3), a rear wall (4), a left side wall (5) and a right side wall (6), to form a receptacle open towards the top, characterised in that, in the left side wall (5) and in the right side wall (6) respectively four grooves (7*a*, 7*b*, 7*c*, 7*d*, 8*a*, 8*b*, 8*c*, 8*d*) are formed, which have upper groove openings (21*a*, 21*b*, 21*c*, 21*d*, 22*a*, 22*b*, 22*c*, 22*d*) and lower groove stops (10*a*, 10*b*, 10*c*, 10*d*, 11*a*, 11*b*, 11*c*, 11*d*), that on the lower edge of the outside of the left side wall (5) and on the lower edge of the outside of the right side wall (6) respectively four guide pegs (12*a*, 12*b*, 12*c*, 12*d*, 13*a*, 13*b*, 13*c*, 13*d*) are formed, that the distances between the guide pegs are different from the distances between the respective upper groove openings and that the distances between the guide pegs are equal to the distances of the lower groove stops.

2. Stackable transport container according to claim 1, characterised in that, in the upper edges of the right side wall (5) and the left side wall (6) respectively four recesses (16*a*, 16*b*, 16*c*, 16*d*, 17*a*, 17*b*, 17*c*, 17*d*) are formed and that the distances between the recesses are equal to the distances of the respective guide pegs.

3. Stackable transport container according to claim 2, characterised in that, the distances between two outer recesses (16*a*–16*b*; 16*c*–16*d*; 17*a*–17*b*; 17*c*–17*d*) are equal but not equal to the distances between two inner recesses (16*b*–16*c*; 17*b*–17*c*) and that the distances between to outer guide pegs (12*a*–12*b*; 12*c*–12*d*; 13*a*–13*b*; 13*c*–13*d*) are equal but not equal to the distances between two inner guide pegs (12*b*–12*c*; 13*b*–13*c*).

4. Stackable transport container according to claim 1, characterised in that the grooves are inclined relative to the vertical and each have a different slope, curve and shape.

5. Stackable transport container according to claim 1, characterized in that, the individual grooves (7), guide pegs (12) and recesses (16) of the left side wall (5) are each identical to the respective individual grooves (8), guide pegs (13) and recesses (17) of the right side wall (6) opposite.

6. Stackable transport container according to claim 1, characterized in that, the grooves (7, 8) on the side walls (5, 6) are formed in the shape of channels on an inside surface of the side walls.

7. Stackable transport container according to claim 1, characterised in that, the grooves (7, 8) go through the side walls (5, 6) forming slits through the walls.

8. Stackable transport container according to claim 1, characterised in that, the outermost ends of the guide pegs are provided with downwardly extending protrusions (213*a*, 213*b*).

9. Stackable transport container according to claim 1, characterized in that, the grooves (7, 8) have a width that is somewhat greater than a diameter of the guide pegs (12, 13).

10. Stackable transport container according to claim 1, characterised in that, the groove stops (10, 11) lie in one horizontal plane.

11. Stackable transport container according to claim 10, characterised in that, the horizontal plane lies close to the middle of the transport container.

12. Stackable transport container according to claim 1, characterised in that, the guide pegs (10, 11) lie in one horizontal plane.

13. Stackable transport container according to claim 12, characterised in that, the horizontal plane lies close to the bottom (2) of the transport container.

14. Stackable transport container according to claim 1, characterised in that, the height of the side walls (5, 6) is equal to the height of the front wall (2) and the rear wall (4).

15. Stackable transport container according to claim 1, characterised in that, the height of the side walls (5, 6) is greater than the height of the front wall (2) and the rear wall (4).

16. Stackable transport container according to claim 1, characterised in that, the upper surface of the site walls (5, 6) and/or of the front wall (3) and/or of the rear wall (4) being provided with upward extending ribs (50*a*, 50*b*, 50*c*).

* * * * *